US009972334B2

(12) United States Patent
Subasingha et al.

(10) Patent No.: US 9,972,334 B2
(45) Date of Patent: May 15, 2018

(54) DECODER AUDIO CLASSIFICATION

(71) Applicant: QUALCOMM Incorporated, San Diego, CA (US)

(72) Inventors: Subasingha Shaminda Subasingha, San Diego, CA (US); Vivek Rajendran, San Diego, CA (US); Venkata Subrahmanyam Chandra Sekhar Chebiyyam, San Diego, CA (US); Venkatraman Atti, San Diego, CA (US); Pravin Kumar Ramadas, San Diego, CA (US); Daniel Jared Sinder, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days. days.

(21) Appl. No.: 15/152,949

(22) Filed: May 12, 2016

(65) Prior Publication Data

US 2017/0076734 A1 Mar. 16, 2017

Related U.S. Application Data

(60) Provisional application No. 62/216,871, filed on Sep. 10, 2015.

(51) Int. Cl.
*G10L 19/00* (2013.01)
*G10L 19/22* (2013.01)
(Continued)

(52) U.S. Cl.
CPC ..... *G10L 19/22* (2013.01); *G10L 19/06* (2013.01); *G10L 19/167* (2013.01); *G10L 19/26* (2013.01);
(Continued)

(58) Field of Classification Search
USPC ..... 704/200–232, 500–504
See application file for complete search history.

(56) References Cited

U.S. PATENT DOCUMENTS

2002/0161576 A1* 10/2002 Benyassine ..... G10L 19/18 704/229
2003/0101050 A1 5/2003 Khalil et al.
(Continued)

FOREIGN PATENT DOCUMENTS

EP 0665530 A1 8/1995
EP 1154408 A2 11/2001
(Continued)

OTHER PUBLICATIONS

Bevilacqua A., et al., "A 6-9-GHz programmable gain LNA with integrated balun in 90-nm CMOS", IEEE International Conference on Ultra-Wideband, vol. 1, Oct. 2008, pp. 25-28.
(Continued)

*Primary Examiner* — Jesse Pullias
(74) *Attorney, Agent, or Firm* — Toler Law Group, P.C.

(57) ABSTRACT

A device includes a decoder configured to receive an encoded audio signal at a decoder and to generate a synthesized signal based on the encoded audio signal. The device further includes a classifier configured to classify the synthesized signal based on at least one parameter determined from the encoded audio signal.

30 Claims, 6 Drawing Sheets

(51) Int. Cl.

| | |
|---|---|
| ***G10L 19/06*** | (2013.01) |
| ***G10L 19/16*** | (2013.01) |
| ***G10L 25/69*** | (2013.01) |
| ***G10L 25/81*** | (2013.01) |
| ***G10L 19/26*** | (2013.01) |
| *G10L 19/20* | (2013.01) |
| *G10L 21/0208* | (2013.01) |

(52) U.S. Cl.
CPC ..... *G10L 25/69* (2013.01); *G10L 25/81* (2013.01); *G10L 19/20* (2013.01); *G10L 21/0208* (2013.01)

(56) References Cited

U.S. PATENT DOCUMENTS

| | | | | |
|---|---|---|---|---|
| 2004/0174984 | A1* | 9/2004 | Jabri | G10L 19/12 379/386 |
| 2006/0015333 | A1* | 1/2006 | Gao | G10L 25/48 704/233 |
| 2006/0106597 | A1* | 5/2006 | Stein | G10L 19/20 704/203 |
| 2006/0271359 | A1* | 11/2006 | Khalil | G10L 21/045 704/226 |
| 2007/0118369 | A1* | 5/2007 | Chen | G10L 19/005 704/229 |
| 2008/0033583 | A1 | 2/2008 | Zopf | |
| 2008/0139158 | A1 | 6/2008 | Chang et al. | |
| 2009/0039977 | A1 | 2/2009 | Lee et al. | |
| 2009/0045885 | A1 | 2/2009 | Sarfaraz | |
| 2010/0004928 | A1 | 1/2010 | Yonekubo et al. | |
| 2011/0046947 | A1 | 2/2011 | Vaillancourt et al. | |
| 2013/0121508 | A1* | 5/2013 | Vaillancourt | H03G 3/20 381/98 |
| 2014/0249807 | A1 | 9/2014 | Vaillancourt et al. | |
| 2014/0278391 | A1 | 9/2014 | Braho et al. | |

FOREIGN PATENT DOCUMENTS

| | | | |
|---|---|---|---|
| EP | 1557820 | A1 | 7/2005 |
| JP | 6276045 | A | 9/1994 |
| RU | 2470385 | C2 | 12/2012 |
| WO | 02080147 | A1 | 10/2002 |
| WO | 2015032351 | A1 | 3/2015 |

OTHER PUBLICATIONS

De Matos M., et al., "A 0.25 μm SiGe Receiver Front-End for 5GHz Applications" Microwave and Optoelectronics, 2005 SBMO/IEEE MTT-s International Conference, IEEE, Jul. 20, 2005, pp. 213-217.

Zencir E., et al., "UHF RF Front-End Circuits in 0.35-μm Silicon on Insulator (SOI) CMOS" Analog Integrated Circuits and Signal Processing, Springer Science + Business Media, Inc. 2005, pp. 231-245.

International Search Report and Written Opinion—PCT/US2016/046610—ISA/EPO—dated Jan. 11, 2017.

Lim, C.C. et al., "Fully Symmetrical Monolithic Transformer (True1 : 1) for Silicon RFIC" IEEE Transaction on Microwave Theory and Techniques, vol. 56, No. 10, Oct. 2008, pp. 2301-2311.

* cited by examiner

DECODER AUDIO CLASSIFICATION

CROSS REFERENCE TO RELATED APPLICATIONS

The present application claims the benefit of U.S. Provisional Patent Application No. 62/216,871, entitled "DECODER AUDIO CLASSIFICATION," filed Sep. 10, 2015, which is expressly incorporated by reference herein in its entirety.

FIELD

The present disclosure is generally related to audio decoder classification.

DESCRIPTION OF RELATED ART

Recording and transmitting of audio by digital techniques is widespread. For example, audio may be transmitted in long distance and digital radio telephone applications. Devices, such as wireless telephones, may send and receive signals representative of human voice (e.g., speech) and non-speech (e.g., music or other sounds).

In some devices, multiple coding technologies are available. For example, an audio coder-decoder (CODEC) of a device may use a switched coding approach to encode or decode a variety of content. To illustrate, the device may include a linear predictive coding (LPC) mode decoder, such as an algebraic code-excited linear prediction (ACELP) decoder, and a transform mode decoder, such as a transform coded excitation (TCX) decoder (e.g., a transform domain decoder) or a Modified Discrete Cosine Transform (MDCT) decoder. A speech mode decoder may be proficient at decoding speech content and a music mode decoder may be proficient at decoding non-speech content and music-like signals, such as ring tones, music on hold, etc. It should be noted that, as used herein, a "decoder" could refer to one of the decoding modes of a switched decoder. For example, the ACELP decoder and the MDCT decoder could be two separate decoding modes within a switched decoder.

A device that includes a decoder may receive an audio signal, such as an encoded audio signal, associated with speech content, non-speech content, music content, or a combination thereof. In some situations, the received speech content may have a poor audio quality, such as speech content that includes background noise. To improve the audio quality of the received audio signal, the device may include a signal preprocessor or a signal post processor, such as a noise suppressor (e.g., a fine noise suppressor). To illustrate, the noise suppressor may be configured to reduce or eliminate the background noise in speech content having poor audio quality. However, if the noise suppressor processes non-speech content, such as music content, the noise suppressor may degrade audio quality of the music content.

SUMMARY

In a particular aspect, a device includes a decoder configured to receive an encoded audio signal at a decoder and to generate a synthesized signal based on the encoded audio signal. The device further includes a classifier configured to classify the synthesized signal based on at least one parameter determined from the encoded audio signal.

In another particular aspect, a method includes receiving an encoded audio signal at a decoder and decoding the encoded audio signal to generate a synthesized signal. The method also includes classifying the synthesized signal based on at least one parameter determined from the encoded audio signal.

In another particular aspect, a computer-readable storage device stores instructions that, when executed by a processor, cause the processor to perform operations including decoding an encoded audio signal to generate a synthesized signal. The operations also include classifying the synthesized signal based on at least one parameter determined from the encoded audio signal.

In another particular aspect, an apparatus includes means for receiving an encoded audio signal. The apparatus also includes means for decoding an encoded audio signal to generate a synthesized signal. The apparatus further includes means for classifying the synthesized signal based on at least one parameter determined from the encoded audio signal.

Other aspects, advantages, and features of the present disclosure will become apparent after review of the application, including the following sections: Brief Description of the Drawings, Detailed Description, and the Claims.

DETAILED DESCRIPTION

Figure 1:
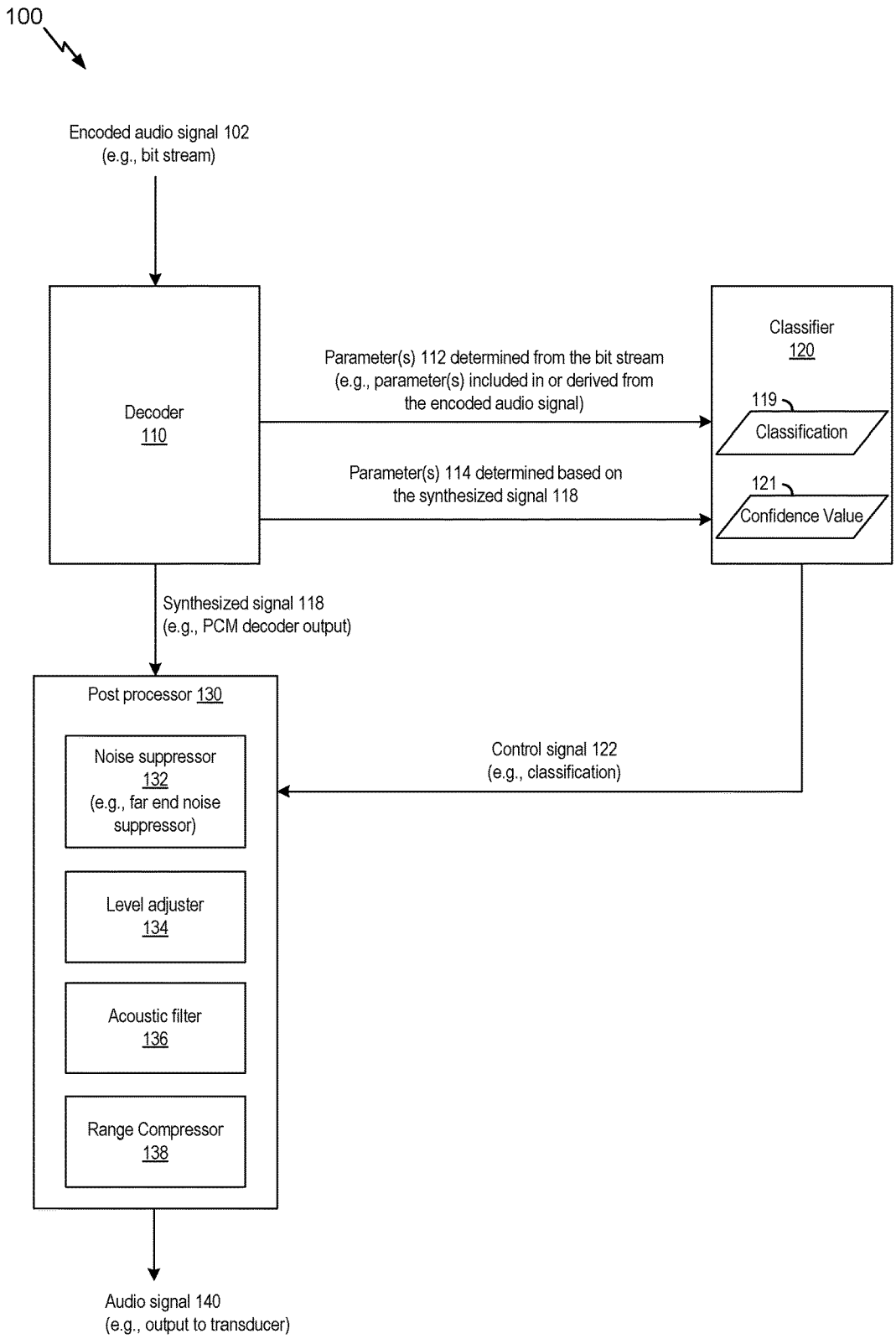
FIG. 1 is a block diagram of a particular illustrative aspect of a system that is operable to process an audio signal.

Particular aspects of the present disclosure are described below with reference to the drawings. In the description, common features are designated by common reference numbers throughout the drawings. As used herein, various terminology is used for the purpose of describing particular implementations only and is not intended to be limiting. For example, the singular forms "a," "an," and "the" are intended to include the plural forms as well, unless the context clearly indicates otherwise. It may be further understood that the terms "comprises" and "comprising" may be used interchangeably with "includes" or "including". Additionally, it will be understood that the term "wherein" may be used interchangeably with "where". As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

The present disclosure is related to classification of audio content, such as a decoded audio signal. The techniques described herein may be used at a device to decode an encoded audio signal to generate a synthesized signal and to classify the synthesized signal as a speech signal or a non-speech signal, such as a music signal. A speech signal (e.g., speech content) may be designated as including active speech, inactive speech, clean speech, noisy speech, or a combination thereof, as illustrative, non-limiting examples. A non-speech signal (e.g., non-speech content) may be designated as including music content, music like content (e.g., music on hold, ring tones, etc.), background noise, or a combination thereof, as illustrative, non-limiting examples. In other implementations, inactive speech, noisy speech, or a combination thereof, may be classified as non-speech content by the device if a particular decoder associated with speech (e.g., a speech decoder) has difficulty decoding inactive speech or noisy speech. In some implementations, classification of the synthesized signal may be performed on a frame-by-frame basis.

The device may classify the synthesized signal based on at least one parameter determined from a bit stream, such as an encoded audio signal. For example, the at least one parameter determined from the bit stream may include a parameter included in (or indicated by) the encoded audio signal. In a particular implementation, the at least one parameter is included in the encoded audio signal and the decoder may be configured to extract the at least one parameter from the encoded audio signal. The parameter included in the encoded audio signal may include a core indicator, a coding mode (e.g., an algebraic code-excited linear prediction (ACELP) mode, a transform coded excitation (TCX) mode, or a modified discrete cosine transform (MDCT)), a coder type (e.g., voiced coding, unvoiced coding, or transient coding), a low pass core decision, or a pitch, such as an instantaneous pitch. To illustrate, the parameter included in the encoded audio signal may have been determined by an encoder that generated the encoded audio signal (e.g., an encoded audio frame). The encoded audio signal may include data that indicates a value of the parameter. Decoding the encoded audio signal (e.g., the encoded audio frame) may generate the parameter (e.g., the value of the parameter) included in (or indicated by) the encoded audio signal.

Additionally or alternatively, the at least one parameter determined from the bit stream may include a parameter that is derived from a set of values (e.g., one or more parameters included in or indicated by the encoded audio signal). In a particular implementation, the decoder may be configured to extract the set of values (e.g., parameters) from the encoded audio signal 102 and to perform one or more calculations using the set of values to determine the at least one parameter. The at least one parameter derived from the set of values in the encoded audio signal may include pitch stability, as an illustrative, non-limiting example. The pitch stability may indicate a rate at which the pitch (e.g., the instantaneous pitch) is changed between multiple consecutive frames of the encoded audio signal. For example, the pitch stability may be calculated using pitch values of (e.g., included in) the multiple consecutive frames of the encoded audio signal.

In some implementations, the device may classify the synthesized signal based on multiple bit stream parameters ("encoded bit stream parameters"), such as at least one parameter included in the encoded audio signal and at least one parameter derived from the encoded audio signal (or one or more parameters thereof). Identifying the encoded bit stream parameters, accurately determining (e.g., deriving) the encoded bit stream parameters, or both, from the bit stream may be less computationally complex and less time consuming than generating such parameters at the device using a decoded version of the bit stream (e.g., the synthesized signal). Additionally, one or more of the encoded bit stream parameters used by the device to classify the received bit stream may not be able to be determined using only the synthesized speech generated by the device.

In some implementations, the device may classify the synthesized signal based on the at least one parameter associated with (e.g., determined from) the bit stream and based on at least one parameter determined based on the synthesized signal. The at least one parameter determined based on the synthesized signal may include a parameter calculated from (e.g., by processing) the synthesized signal. The at least one parameter determined based on the synthesized signal may include a signal-to-noise ratio, a zero crossing, an energy distribution (e.g., a fast Fourier transform (FFT) energy distribution), an energy compaction, a signal harmonicity, or a combination thereof.

In some implementations, the device may be configured to selectively perform one or more operations in response to a classification of the synthesized signal. For example, the device may be configured to selectively perform noise suppression on the synthesized signal based on the classification. To illustrate, the device may activate noise suppression to be performed on the synthesized signal in response to the synthesized signal being classified as a speech signal. Alternatively, the device may deactivate (or adjust) noise suppression performed on the synthesized signal in response to the synthesized signal being classified as a non-speech signal, such as a music signal. For example, if the synthesized signal is classified as a music signal, noise suppression may be adjusted to a less aggressive setting, such as a setting that provides less noise suppression. Additionally, the device may selectively perform gain adjustment, acoustic filtering, dynamic range compression, or a combination thereof, on the synthesized signal (or a version thereof) based on the classification. As another example, in response to the classification of the synthesized audio signal, the device may select a linear predictive coding (LPC) mode decoder (e.g., a speech mode decoder) or a transform mode decoder (e.g., a music mode decoder) to be used to decode the encoded audio signal.

Additionally or alternatively, the device may be configured to selectively perform one or more operations based on a confidence value associated with the classification of the synthesized signal. To illustrate, the device may be configured to generate a confidence value associated with a classification of the synthesized signal. The device may be configured to selectively perform the one or more operations based on a comparison of the confidence value to one or more thresholds. For example, the device may perform the one or more operations in response to the confidence value exceeding a threshold. Additionally or alternatively, the device may be configured to selectively set (or adjust) parameters of the one or more operations based on a comparison of the confidence value to one or more thresholds.

One particular advantage provided by at least one of the disclosed aspects is that a device may classify a synthesized signal using a set of parameters determined from (e.g., associated with) an encoded audio signal (e.g., a bit stream) that corresponds to the synthesized signal. The set of parameters may include a parameter included in (or indicated by) the encoded audio signal, a parameter determined based on the synthesized audio signal, a parameter derived (e.g., calculated) based on one or more values included in (or indicated by) the encoded audio signal, or a combination thereof. Using the set of parameters to classify the synthesized signal may be faster and less computationally complex than conventional approaches of classifying an audio signal as a speech signal or a non-speech signal. In some implementations, the device may classify the synthesized signal using other classifications, such as a music signal, a non-music signal, a background noise signal, a noisy speech signal, or an inactive signal. The device may extract and utilize one or more parameters determined by an encoder and included in (or indicated by) the encoded audio signal. In some implementations, parameter data (e.g., one or more parameter values) may be encoded and included in the encoded audio signal. Extracting the one or more parameters may be faster than the device generating the one or more parameters on its own from the synthesized signal. Additionally, generating one or more parameters (e.g., coding mode, coder type, etc.) by the device may be extremely complex and time consuming.

In some implementations, the set of parameters used to classify the synthesized signal may include fewer parameters than used by conventional techniques to classify an audio signal. Thus, the device may determine a classification of the synthesized signal and may selectively perform one or more operations, such as post processing (e.g., noise suppression), preprocessing, or selecting a type of decoding, based on the classification. Selectively performing the one or more operations may improve a quality of an audio output of the device. For example, selectively performing the one or more operations may improve a music output of the device by not performing noise suppression which may degrade a quality of a music signal.

Referring to FIG. 1, a particular illustrative example of a system 100 operable to process a received audio signal (e.g., an encoded audio signal) is disclosed. In some implementations, the system 100 may be included in a device, such as an electronic device (e.g., a wireless device), as described with reference to FIG. 5.

The system 100 includes a decoder 110, a classifier 120, and a post processor 130. The decoder 110 may be configured to receive an encoded audio signal 102, such as a bit stream. The encoded audio signal 102 may include speech content, non-speech content, or both. In some implementations, speech content may be designated as including active speech, inactive speech, noisy speech, or a combination thereof, as illustrative, non-limiting examples. Non-speech content may be designated as including music content, music-like content (e.g., music on hold, ring tones, etc.), background noise, or a combination thereof, as illustrative, non-limiting examples. In other implementations, inactive speech, noisy speech, or a combination thereof, may be classified as non-speech content by the system 100 if a particular decoder associated with speech (e.g., a speech decoder) has a difficulty decoding inactive speech or noisy speech. In another implementation, background noise may be classified as speech content. For example, the system 100 may classify background noise as speech content if a particular decoder associated with speech (e.g., a speech decoder) is proficient at decoding background noise. In some implementations, the encoded audio signal 102 may have been generated by an encoder (not shown). The encoder may be included in a different device from the device that includes the system 100. For example, the encoder may receive an audio signal, encode the audio signal to generate the encoded audio signal 102, and send (e.g., wirelessly transmit) the encoded audio signal 102 to a device that includes the decoder 110. In some implementations, the decoder 110 may receive the encoded audio signal 102 on a frame-by-frame basis.

The decoder 110 may also be configured to generate a synthesized signal 118 based on the encoded audio signal 102. For example, the decoder 110 may decode the encoded audio signal 102 using a linear predictive coding (LPC) mode decoder, a transform mode decoder, or another decoder type, included in the decoder 110, as described with reference to FIG. 2. In some implementations, after decoding the encoded audio signal 102, the decoder 110 may generate a pulse-code modulated (PCM) decoded audio signal to generate the synthesized signal 118 (e.g., a PCM decoder output). The synthesized signal 118 may be provided to the post processor 130.

The decoder 110 may further be configured to generate a set of parameters associated with the encoded audio signal 102 (e.g., the synthesized signal 118). In some implementations, the set of parameters may be generated by the decoder 110 on a frame-by-frame basis. For example, the decoder 110 may generate a particular set of parameters for a particular frame of the encoded audio signal 102 and a corresponding portion of the synthesized signal 118 generated based on the particular frame. In some implementations, one or more parameters may be included in (or indicated by) the encoded audio signal 102, and the decoder 110 may be configured to extract the one or more parameters from the encoded audio signal 102. In a particular implementation, the decoder 110 may extract the one or more parameters prior to decoding the encoded audio signal 102. Additionally or alternatively, the decoder 110 may be configured to extract a set of values (e.g., parameters) from the encoded audio signal 102. The decoder 110 may be configured to perform one or more calculations using the set of values to determine one or more parameters. For example, the decoder 110 may extract one or more pitch values from the encoded audio signal 102 and the decoder 110 may perform a calculation using the one or more pitch values to determine a pitch stability parameter, as further described herein. The decoder 110 may provide the set of parameters to the classifier 120, as described further herein.

The set of parameters may include at least one parameter 112 determined from the bit steam (e.g., the encoded audio signal 102), a parameter 114 determined based on the synthesized signal 118, or a combination thereof. The parameter 114 determined based on the synthesized signal 118 may include a signal-to-noise ratio (SNR), a zero crossing, an energy distribution, an energy compaction, a signal harmonicity, or a combination thereof, as illustrative, non-limiting examples. The parameter 114 determined based on the synthesized signal may include a parameter calculated from (e.g., by processing) the synthesized signal.

The at least one parameter 112 determined from the bit steam (e.g., the encoded audio signal 102) may include a parameter that is included in (or indicated by) the encoded audio signal 102, a parameter derived from the encoded audio signal 102, or a combination thereof. In some implementations, the encoded audio signal 102 may include (or indicate) one or more parameters (e.g., parameter data). For example, parameter data may be included in (or indicated by) the encoded audio signal 102. The decoder 110 may receive the parameter data and may identify the parameter data on a frame-by-frame basis. To illustrate, the decoder 110 may determine a parameter (e.g., a parameter value based on the parameter data) included in (or indicated by) the encoded audio signal 102. In some implementations, a parameter that is included in (or indicated by) the encoded audio signal 102 may be determined (or generated) during decoding of the encoded audio signal 102. For example, the decoder 110 may decode the encoded audio signal 102 to determine a parameter (e.g., a parameter value). Alternatively, the decoder 110 may extract the parameters (e.g., the indications) from the encoded audio signal 102 prior to decoding the encoded audio signal 102.

The parameters included in (or indicated by) the encoded audio signal 102 may have been used by the encoder to generate the encoded audio signal 102 and the encoder may have included an indication of each parameter in the encoded audio signal 102. As illustrative, non-limiting examples, the parameters included in the encoded audio signal may include a core indicator, a coding mode, a coder type, a low pass core decision, a pitch, or a combination thereof. The core indicator may indicate a core (e.g., an encoder), such as a LPC mode encoder (e.g., a speech mode encoder), a transform mode encoder (e.g., a music mode encoder), or another core type, used by the encoder to generated the encoded audio signal 102. The coding mode may indicate a coding mode used by the encoder to generate the encoded audio signal 102. The coding mode may include an algebraic code-excited linear prediction (ACELP) mode, a transform coded excitation (TCX) mode, a modified discrete cosine transform (MDCT) mode, or another coding mode, as illustrative, non-limiting examples. The coder type may indicate a type of coder used by the encoder to generate the encoded audio signal 102. The coder type may include a voiced coding, unvoiced coding, transient coding, or another coder type, as illustrative, non-limiting examples. In some implementations, the decoder 110 may determine (or generate) the coder type parameter during decoding of the encoded audio signal 102, as described further with reference to FIG. 2. The low pass core decision for a particular frame may be generated as a weighted sum of the core decision for the frame and the low pass core decision for the preceding frame (e.g., lp_core(frame n)=a*core(frame n)+b*(lp_core(frame n−1)), where a and b are values in a range from 0 to 1. The range may be inclusive or exclusive. In other implementations, other ranges may be used for the values of a and b.

The parameter derived from (e.g., calculated based on) the encoded audio signal 102 (or one or more parameters thereof) may include pitch stability, as an illustrative, non-limiting example. For example, the at least one parameter 112 may be derived from one or more values (e.g., parameters) included in (or indicated by) the encoded audio signal 102, decoded from the encoded audio signal 102, or a combination thereof. To illustrate, the pitch stability may be derived as (e.g., calculated based on) an average of individual pitch values for a number of most recently received frames of the encoded audio signal 102. In some implementations, the decoder 110 may calculate (or generate) the pitch stability during decoding of the encoded audio signal 102, as described further with reference to FIG. 2.

The classifier 120 may be configured to classify the synthesized signal 118 as a speech signal or a non-speech signal (e.g., a music signal) based on the at least one parameter 112. In some implementations, the synthesized signal 118 may be classified based on the at least one parameter 112 and a parameter 114. For example, the classifier 120 may determine a classification 119 of the synthesized signal 118 based on the at least one parameter 112 and the parameter 114. The classification 119 may indicate whether the synthesized signal 118 is classified as a speech signal or a music signal. In other implementations, the classifier 120 may be configured to classify the synthesized signal 118 as one or more other classifications. For example, the classifier 120 may be configured to classify the synthesized signal 118 as a speech signal or as a music signal. As another example, the classifier 120 may be configured to classify the synthesized signal 118 as a speech signal, a non-speech signal, a noisy speech signal, a background noise signal, a music signal, a non-music signal, or a combination thereof, as illustrative, non-limiting examples. Classifying the synthesized signal 118 based on the set of parameters is described further with reference to FIGS. 3-4. The classifier 120 may provide a control signal 122 to the post processor 130, to a preprocessor (not shown), or to the decoder 110. In some implementations, the control signal 122 may include the classification 119 or an indication thereof, such as classification data that indicates the classification 119. For example, the classifier 120 may be configured to output the classification 119 of the synthesized signal 118.

In some implementations, the classifier 120 may be configured to generate a confidence value 121 associated with the classification 119 of the synthesized signal 118. The classifier 120 may be configured to output the confidence value 121 or an indication thereof, such as confidence value data. For example, the control signal 122 may include confidence value data that indicates the confidence value 121.

The post processor 130 may be configured to process the synthesized signal 118 to generate an audio signal 140. For example, the audio signal 140 may be provided to one or more transducers, such as a speaker. The one or more transducers may be included in or coupled to a device that includes the system 100.

The post processor 130 may include a noise suppressor 132, a level adjuster 134, an acoustic filter 136, and a range compressor 138. The noise suppressor 132 may be configured to perform noise suppression on the synthesized signal 118 (or a version thereof). The level adjuster 134 (e.g., a gain adjuster) may be configured to adjust a power level of the synthesized signal 118. In some implementations, the level adjuster 134 may include or correspond to an adaptive gain controller. The acoustic filter 136, such as a low-pass filter, may be configured to filter at least a portion of the synthesized signal 118 to reduce sound components in a particular frequency range of the synthesized signal 118 (or a version thereof, such as a noise suppressed version of the synthesized signal 118). The range compressor 138 may be configured to adjust (e.g. compress) a dynamic range value (or ratio) or a multiband dynamic range value (or ratio) of the synthesized signal 118 (or a version thereof, such as a noise suppressed or level adjusted version of the synthesized signal 118). The range compressor 138 may include or correspond to a dynamic range compressor, a multiband dynamic range compressor, or both. In other implementations, the post processor 130 may include other post processing devices or circuitry configured to process the synthesized signal 118 to generate the audio signal 140. The synthesized signal 118 may be processed sequentially (in any order) by one or more of the post processing stages or components, such as the noise suppressor 132, the level adjuster 134, the acoustic filter 136, or the range compressor 138. For example, the level adjuster 134 may process the synthesized signal 118 before the acoustic filter 136 and after the noise suppressor 132. As another example, the level adjuster 134 may process the synthesized signal before the noise suppressor 132 and after the acoustic filter 136.

The noise suppressor 132 may be used to process the synthesized signal 118 responsive to the control signal 122. For example, the noise suppressor 132 may be configured to selectively perform noise suppression on the synthesized signal 118 based on the control signal 122 (e.g., the classification 119, the confidence value 121, or both). To illustrate, the noise suppressor 132 may be configured to perform noise suppression on the synthesized signal 118 in response to the synthesized signal 118 being classified as the speech signal. For example, the noise suppressor 132 may activate noise suppression or adjust a level of noise suppression applied to the synthesized signal 118. Additionally, the noise suppressor 132 may be configured to be deactivated (e.g., to not perform noise suppression of the synthesized signal 118) in response to the synthesized signal 118 being classified as the music signal. Additionally or alternatively, in other implementations, the control signal 122 may be provided to one or more other components to selectively operate the one or more other components. The one or more other components may include or correspond to the level adjuster 134, the acoustic filter 136, the range compressor 138, another component configured to process the synthesized signal 118 (or a version thereof), or a combination thereof.

Additionally or alternatively, the post processor 130 (or one or more components thereof) may be configured to selectively perform one or more post processing operations based on the confidence value 121 associated with the classification 119 of the synthesized signal 118. For example, the control signal 122 may include data (e.g., confidence value data) indicating the confidence value 121. The post processor 130 may selectively perform one or more operations based on a comparison of the confidence value 121 to one or more thresholds. To illustrate, the post processor 130 may compare the confidence value 121 to a first threshold. The post processor 130 may activate the noise suppressor 132 (e.g., perform noise suppression on the synthesized signal 118) based on determining that the confidence value 121 is greater than or equal to the first threshold. In some implementations, the post processor 130 may perform a comparison of the confidence value 121 to the first threshold based on the classification 119. For example, the post processor 130 may compare the confidence value 121 to the first threshold when the classification 119 indicates speech, and the post processor 130 may refrain from comparing the confidence value 121 to the first threshold when the classification 119 indicates music, as illustrative, non-limiting examples.

Additionally or alternatively, the post processor 130 (or one or more components thereof) may be configured to selectively set (or adjust) parameters of the one or more operations based on a comparison of the confidence value 121 to one or more thresholds. To illustrate, the post processor 130 may compare the confidence value 121 to a second threshold. The post processor 130 may adjust a parameter of one or more components (e.g., a noise suppression parameter of the noise suppressor 132) based on determining that the confidence value 121 is greater than or equal to the second threshold. In some implementations, the post processor 130 may perform a comparison of the confidence value 121 to the second threshold based on the classification 119. For example, the post processor 130 may compare the confidence value 121 to the second threshold when the classification 119 indicates speech, and the post processor 130 may refrain from comparing the confidence value 121 to the second threshold when the classification 119 indicates music, as illustrative, non-limiting examples.

During operation, the decoder 110 may receive a frame of the encoded audio signal 102 and output a portion of the synthesized signal 118 that corresponds to the frame of the encoded audio signal 102. The decoder 110 may generate a set of parameters based on the encoded audio signal 102, the synthesized signal 118, or a combination thereof.

The classifier 120 may receive the set of parameters and may classify (e.g., determine the classification 119) the synthesized signal 118 based on the set of parameters. For example, the classifier 120 may classify the portion of the synthesized signal 118 as being a speech signal or a music signal. Based on the classification 119 of the portion of the synthesized signal 118, the post processor 130 may selectively perform one or more processing functions on the synthesized signal 118 to generate the audio signal 140. For example, based on the classification 119 as indicated by the control signal 122, the post processor 130 may selectively perform noise suppression, as an illustrative, non-limiting example. In some implementations, the level adjuster 134, the acoustic filter 136, the range compressor 138, another component of the post processor 130, or a combination thereof, may process a noise suppressed version of the portion of the synthesized signal 118 to generate the audio signal 140.

Additionally or alternatively, the post processor 130 (or one or more components thereof) may selectively perform one or more operations based on the confidence value 121 associated with the classification 119 of the synthesized signal 118. For example, the post processor 130 may selectively perform noise suppression on the synthesized signal 118 based on determining that the confidence value 121 is greater than or equal to a first threshold. Additionally or alternatively, the post processor 130 may selectively set (or adjust) parameters of the operations based on a comparison of the confidence value 121 to a second threshold. For example, the post processer 130 (or the noise suppressor 132) may increase a noise suppression parameter of the noise suppressor 132 based on determining that the confidence value 121 is greater than or equal to the second threshold. In other implementations, the one or more operations may be performed or the parameters may be set, when the confidence value 121 is less than the threshold.

In some implementations, the post processor 130 may be coupled to multiple transducers (e.g., two or more transducers), such as a first speaker and a second speaker. The audio signal 140 may be routed to each of the transducers. Alternatively, the post processor 130 may be configured to selectively route the audio signal 140 to one or more transducers of the multiple transducers based on the classification 119 of the synthesized signal 118. To illustrate, the audio signal 140 may be routed to a first set of transducers of the multiple transducers if the synthesized signal 118 is classified as being a speech signal. For example, the first set of transducers may include the first speaker but not the second speaker. The audio signal 140 may be routed to a second set of transducers of the multiple transducers if the synthesized signal 118 is classified as being a non-speech signal, such as a music signal. For example, the second set of transducers may include the second speaker but not the first speaker.

In some implementations, a "smoothing" of the output of the classifier 120 (e.g., a value of the control signal 122) may be implemented using hysteresis. The techniques described herein may be used to set a value of an adjustment parameter (e.g., a hysteresis metric) that is used to bias a selection toward a particular decoder (e.g., the speech decoder). For example, if an audio signal has a first classification (e.g., the classification 119 indicates music), the classifier 120 may apply hysteresis to delay (or prevent) switching the output (e.g., a value of the control signal 122) to indicate the first classification. Additionally, the classifier 120 may maintain the output as indicating a second classification (e.g., speech) until a threshold number of sequential frames of the audio signal have been identified as having the first classification.

In some implementations, the decoder 110 may include multiple decoders, such as a LPC mode decoder (e.g., a speech mode decoder) and a transform mode decoder (e.g., a music mode decoder), as described with reference to FIG. 2. The decoder 110 may select one of the multiple decoders to decode the received encoded audio signal 102. In some implementations, the decoder 110 may be configured to receive the control signal 122. The decoder 110 may select between decoding the encoded audio signal 102 using the LPC mode decoder or the transform mode decoder based at least in part on the control signal 122. For example, the decoder 110 may select the LPC mode decoder based on the classification 119 indicated by the control signal 122.

Although various functions performed by the system 100 of FIG. 1 have been described as being performed by certain components or modules, this division of components and modules is for illustration only. In an alternate example, a function performed by a particular component or module may instead be divided among multiple components or modules. Moreover, in an alternate example, two or more components or modules of FIG. 1 may be integrated into a single component or module. For example, the decoder 110 may be configured to perform operations described with reference to the classifier 120. To illustrate, in some implementations, the classifier 120 (or a portion thereof) may be included in the decoder 110. Each component or module illustrated in FIG. 1 may be implemented using hardware (e.g., an application-specific integrated circuit (ASIC), a digital signal processor (DSP), a controller, a field-programmable gate array (FPGA) device, etc.), software (e.g., instructions executable by a processor), or any combination thereof.

The system 100 may be configured to classify the synthesized signal 118 (corresponding to a particular audio frame) as a speech signal or as a non-speech signal (e.g., a music signal). For example, the system 100 may classify the synthesized signal 118 based on the at least one parameter 112. By using the at least one parameter 112, classification of the synthesized signal 118 performed by the system 100 may be less computationally complex as compared to conventional classification techniques. Based on the classification of the synthesized signal 118, the system 100 may selectively perform one or more operations on the synthesized signal 118, such as post processing, preprocessing, or selecting a decoder type. Selectively (e.g., dynamically) performing the one or more operations, such as one or more post processing techniques, on the synthesized signal 118 may improve an audio quality associated with the synthesized signal 118. For example, the system 100 may turn off noise suppression to avoid degrading an audio quality when the synthesized signal 118 is classified as a music signal. Thus, the system 100 includes a low complexity speech music classifier with high classification accuracy.

In addition, the system enables classification independent of an encoding classification (if any) that may be determined by an encoder of the encoded audio signal. For example, such encoding classifications by the encoder may not be directly communicated in the bit stream to the decoder 110. Further, there may be a misclassification in an encoder classification decision (e.g., a speech music classification), especially for signals showing both speech and music characteristics (mixed music). Classification of the encoded audio signal 102 at the system 100 enables independent determination of audio characteristics that may be used for post processing or other decoder operations.

Figure 2:
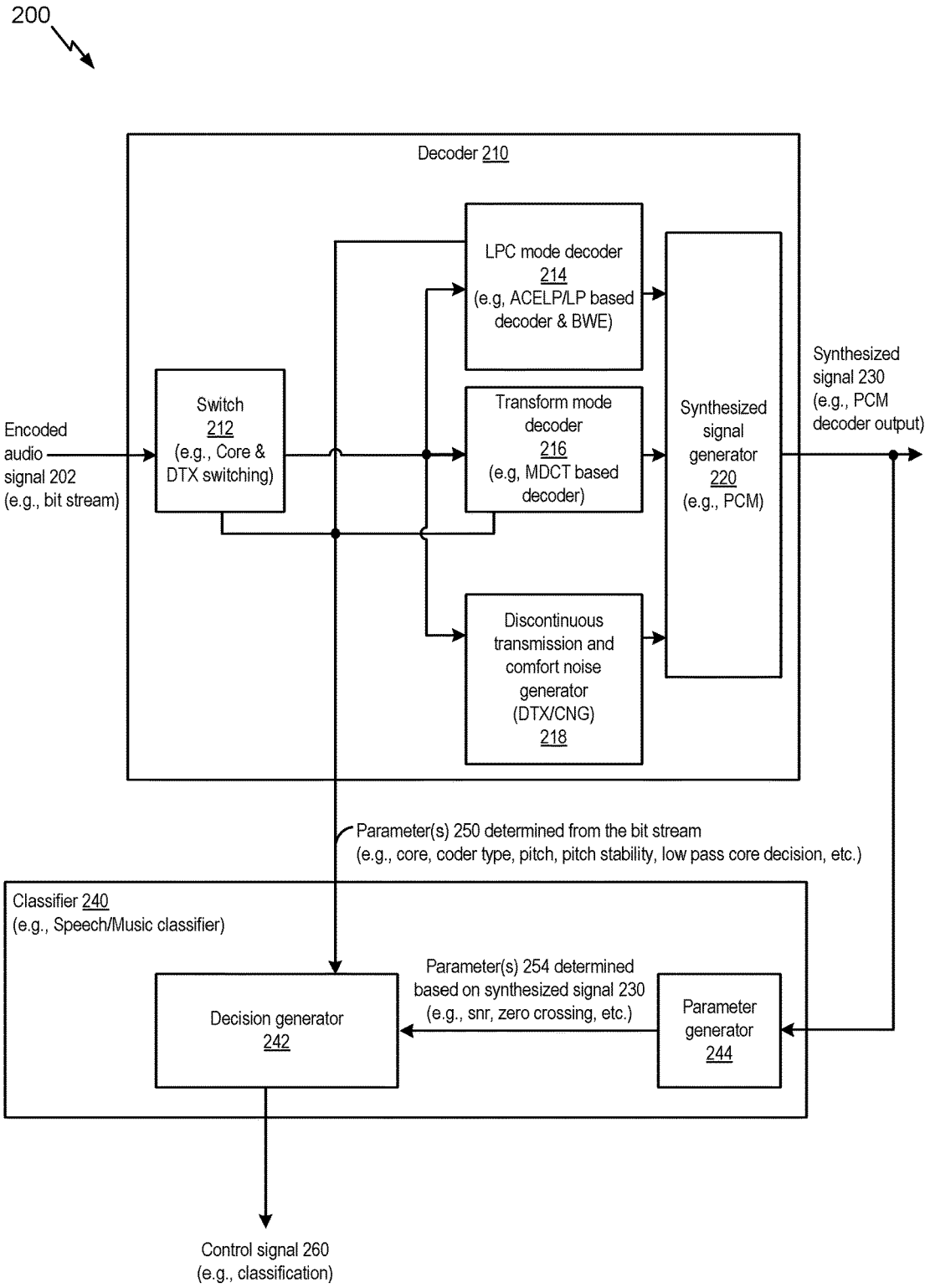
FIG. 2 is a block diagram of another particular illustrative aspect of a system that is operable to process an audio signal.

Referring to FIG. 2, a particular illustrative example of a system 200 operable to process a received audio signal (e.g., an encoded audio signal) is disclosed. For example, the system 200 may include or correspond to the system 100. In some implementations, the system 200 may be included in a device, such as an electronic device (e.g., a wireless device), as described with reference to FIG. 5.

The system 200 includes a decoder 210 and classifier 240. The decoder 210 may include or correspond to the decoder 110 of FIG. 1. The classifier 240 may include or correspond to the classifier 120 of FIG. 1.

The decoder 210 may be configured to receive an encoded audio signal 202, such as a bit stream. For example, the encoded audio stream may include or correspond to the encoded audio signal 102 (e.g., an encoded audio stream) of FIG. 1. The encoded audio signal 202 may include speech content or non-speech content, such as music content. In some implementations, the decoder 210 may receive the encoded audio signal 202 on a frame-by-frame basis.

The decoder 210 may include a switch 212, a LPC mode decoder 214, a transform mode decoder 216, a discontinuous transmission and comfort noise generator (DTX/CNG) 218, and a synthesized signal generator 220. The switch 212 may be configured to receive the encoded audio signal 202 and to route the encoded audio signal 202 to one of the LPC mode decoder 214, the transform mode decoder 216, or the DTX/CNG 218. For example, the switch 212 may be configured to identify one or more parameters included in (or indicated by) the encoded audio signal 202 (e.g., an encoded audio stream) and to route the encoded audio signal 202 based on the one or more parameters. The one or more parameters included in the encoded audio signal 202 may include a core indicator, a coding mode, a coder type, low pass core decision, or a pitch value.

The core indicator may indicate a core (e.g., an encoder), such as a speech encoder or a non-speech (e.g., music) encoder, used by an encoder (not shown) to generate the encoded audio signal 202. The coding mode may correspond to a coding mode used by the encoder to generate the encoded audio signal 102. The coding mode may include an algebraic code-excited linear prediction (ACELP) mode, a transform coded excitation (TCX) mode, or a modified discrete cosine transform (MDCT) mode, as illustrative, non-limiting examples. The coder type may indicate a coder type used by the encoder to generate the encoded audio signal 102. The coder type may include a voiced coding, unvoiced coding, or transient coding, as illustrative, non-limiting examples.

The LPC mode decoder 214 may include an algebraic code-excited linear prediction (ACELP) encoder. In some implementations, the LPC mode decoder 214 may also include a bandwidth extension (BWE) component. The transform mode decoder 216 may include a transform coded excitation (TCX) decoder or a modified discrete cosine transform (MDCT) decoder. The DTX/CNG 218 may be configured to reduce information of the bit stream associated with background content (e.g., background speech or background music). To illustrate, if the bit stream transmitted by the encoder to the decoder 210 only includes the information regarding the background content, the DTX/CNG 218 may use the information to generate one or more parameters that corresponds to the background regions. For example, the DTX/CNG 218 may determine one or more parameters from the information and extrapolate the one or more parameters from the information to generate the one or more parameters that correspond to the background regions.

The synthesized signal generator 220 may be configured to receive an output of one of the LPC mode decoder 214, the transform mode decoder 216, the DTX/CNG 218, or another decoder type, that processes the encoded audio signal 202. The synthesized signal generator 220 may be configured to perform one or more processing operations on the output to generate a synthesized signal 230. For example, the synthesized signal generator 220 may be configured to generate the synthesized signal 230 as a pulse-code modulation (PCM) signal. The synthesized signal 230 may be output by the decoder 210 and provided to the classifier 240, at least one transducer (e.g., a speaker), or both.

In addition to generating the synthesized signal 230, the decoder 210 may be configured to determine at least one parameter 250 associated with (e.g., determined from) the encoded audio signal 202 (e.g., the bit stream). The at least one parameter 250 may be provided to the classifier 240. The at least one parameter 250 may include or correspond to the at least one parameter 112 of FIG. 1. The at least one parameter 250 may include a parameter included in (or indicated by) the encoded audio signal 202, a parameter derived from the encoded audio signal 202 (e.g., from one or more parameters or values included in the encoded audio signal 202), or a combination thereof. In some implementations, the encoded audio signal 202 may include (or indicate) one or more parameters (e.g., parameter data). Parameter data may be included in (or indicated by) the encoded audio signal 202. The decoder 210 may receive the parameter data and may identify the parameter data on a frame-by-frame basis. To illustrate, the decoder 210 may determine a parameter (e.g., a parameter value based on the parameter data) included in (or indicated by) the encoded audio signal 202. In some implementations, a parameter that is included in (or indicated by) the encoded audio signal 202 may be determined (or generated) during decoding of the encoded audio signal 202. For example, the decoder 210 may decode the encoded audio signal 202 to determine a parameter (e.g., a parameter value).

The at least one parameter 250 included in (or indicated by) the encoded audio signal 202 may include a core indicator, a coder type, a low pass core decision, pitch, or a combination thereof, as illustrative, non-limiting examples. The core indicator, the coder type, the low pass core decision, the pitch, or a combination thereof, may be included in (or indicated by) the encoded audio signal 202. The parameter derived from the encoded audio signal 202 (or from the one or more parameters included in the encoded audio signal 202) may include pitch stability, as an illustrative, non-limiting example. The pitch stability may be derived (e.g., calculated) from one or more pitch values for a number of most recently received frames of the encoded audio signal 202. In some implementations, the at least one parameter 250 may include multiple parameters, such as the low pass core decision provided by the switch 212 and the pitch stability provided by the LPC mode decoder 214 or the transform mode decoder 216. As another example, the multiple parameters may include the core indicator provided by the switch 212 and the coder type provided by the LPC mode decoder 214 or the transform mode decoder 216.

The classifier 240 may be configured to receive the synthesized signal 230 and the at least one parameter 250. The classifier 240 may be configured to generate an output that indicates a classification of the synthesized signal 230 based on the synthesized signal 230 and the at least one parameter 250. The classifier 240, such as a speech music classifier, may include a decision generator 242 and a parameter generator 244. The parameter generator 244 may be configured to receive the synthesized signal 230 and to generate one or more parameters, such as a parameter 254, based on the synthesized signal 230. The parameter 254 may include or correspond to the parameter 114 of FIG. 1. In some implementations, the parameter 254 determined based on the synthesized signal 230 may include a parameter calculated from (e.g., by processing) the synthesized signal 230.

The decision generator 242 may be configured to generate a classification of the synthesized signal 230 (corresponding to a frame of the encoded audio signal 202). The classification may include or correspond to the classification 119 of FIG. 1. The decision generator 242 may generate the classification based the at least one parameter 250, the parameter 254, or a combination thereof. The decision generator 242 may include hardware, software, or a combination thereof that is configured to generate a control signal 260 that indicates the classification of the synthesized signal 230. For example, the decision generator 242 may include one or more adders (e.g., AND gates), one or more multipliers, one or more OR gates, one or more registers, one or more comparators, or a combination thereof, as illustrative, non-limiting examples. The control signal 260 may include or correspond to the control signal 122 of FIG. 1. In some implementations, the decision generator 242 may be configured to use first processing (e.g., a first classification algorithm) to generate the classification if the LPC mode decoder 214 is used to decode the encoded audio signal 202. Alternatively, the decision generator 242 may be configured to use second processing (e.g., a second classification algorithm) to generate the classification if the transform mode decoder 216 is used to decode the encoded audio signal 202.

During operation the decoder 210 may receive a frame of the encoded audio signal 202. The decoder 210 may route the frame to the LPC mode decoder 214 or the transform mode decoder 216 to decode the frame. The decoded frame may be provided to the synthesized signal generator 220 which generates the synthesized signal 230. The decoder 210 may provide the synthesized signal 230, along with multiple parameters (e.g., the at least one parameter 250) to the classifier 240.

The parameter generator 244 of the classifier 240 may determine the parameter 254 based on the synthesized signal 230. The decision generator 242 (of the classifier 240) may receive the at least one parameter 250, the parameter 254, or a combination thereof, and may generate the control signal 260 that indicates a classification of the frame (of the synthesized signal 230) as a speech signal or a non-speech signal (e.g., a music signal).

Although the classifier 240 (e.g., the decision generator 242 and the parameter generator 244) is described as being separate from the decoder 210, in other implementations, at least a portion of the classifier 240 may be included in the decoder 210. For example, in some implementations, the decoder 210 may include the decision generator 242, the parameter generator 244, or both.

Examples of computer code illustrating possible implementations of aspects described with respect to FIGS. 1-4 are presented below. In the examples, the term "st–>" indicates that the variable following the term is a state parameter (e.g., a state of the decoder 110 of FIG. 1, the decoder 210, the switch 212, or a combination thereof).

A set of conditions may be evaluated to determine whether to classify a frame of an encoded audio signal, such as the encoded audio signal 102 of FIG. 1 or the encoded audio signal 202 of FIG. 2, as speech or music as indicated in Example 1. The frame of the encoded audio signal may be decoded by a LPC mode decoder or a transform mode decoder. A value of "codec_mode" may indicate whether the frame is decoded using the LPC mode decoder or the transform mode decoder.

In the provided examples, the "==" operator indicates an equality comparison, such that "A==B" has a value of TRUE when the value of A is equal to the value of B and has a value of FALSE otherwise. The ">" (greater than) operator represents "greater than", the ">=" operator represents "greater than or equal to", and the "<" operator indicates "less than". The computer code includes comments which are not part of the executable code. In the computer code, a beginning of a comment is indicated by a forward slash and asterisk (e.g., "/*") and an end of the comment is indicated by an asterisk and a forward slash (e.g., "*/"). To illustrate, a comment "COMMENT" may appear in the pseudo-code as/* COMMENT */. As noted previously, the "st–>A" term indicates that A is a state parameter (i.e., the "–>" characters do not represent a logical or arithmetic operation). In the provided examples, "*" may represent a multiplication operation, "+" may represent an addition operation, "–"may indicate a subtraction operation, "abs(x)" may represent an absolute value of a number x. The "–=" operator represents a decrement operation, such as a decrement by 1 operation. The "=" operator represents an assignment (e.g., "a=1" assigns the value of 1 to the variable "a").

In the provided examples, "core" may indicate a core value of a frame of the encoded audio signal. A core value of 1 may indicate the frame was encoded as a non-speech frame and a core value of 0 may indicate the frame was encoded as a speech frame. The "coder_type" may indicate a type of coder used to encode the frame. A coder type value of 2 may indicate the coder type was a speech coder and a coder type of 1 may indicate the coder type was a non-speech coder. Each of the "core" and "coder type" may be included in the frame.

The "coder_type" may be used to determine a low pass coder type value designated "lp_coder_type". The "lp_coder_type" may be determined as:

$$st\text{–>}lp_coder_type=(\alpha_1 * st\text{–>}lp_coder_type+(1-\alpha_1)*abs(coder_type)), \quad \text{[Equation 1]}$$

where $\alpha_1$ is a number between 0 and 1 inclusive.

The "core" may be used to determine a low pass core value designated "d_lp_core".

The "d_lp_core" may be determined as:

$$st\text{–>}d_lp_core=(\beta_1 * st\text{–>}d_lp_core+(1-\beta_1)*st\text{–>}core), \quad \text{[Equation 2]}$$

where $\beta_1$ is a number between 0 and 1 inclusive.

The "lp_pitch_stab" may indicate a pitch stability (or a low pass pitch stability) of one or more received frames. For example, each frame (e.g., encoded frame) may include a corresponding "instantaneous" pitch of the frame. Pitch stability may indication an amount of variation of the instantaneous pitch values. The "d_lp_snr" may indicate a SNR (or a low pass SNR) corresponding to a portion of a synthesized signal that corresponds to the frame of the encoded audio signal.

The "dec_spmu" may indicate a decision of speech music classification. For example, "st–>dec_spmu=1" indicates that the frame is classified as music and "st–>dec_spmu=0" indicates that the frame is classified as speech. In other implementations, "st–>dec_spmu=1" indicates that the frame is classified as non-speech. The "p1" is a probability (e.g., a confidence value) associated with a particular speech music classification. The "p1" may correspond to the confidence value 121 of FIG. 1. The "sp_hist" represents a speech decision history countdown counter and "mu_hist" represents a music decision history countdown counter. The "p1", the "sp_hist", and the "mu_hist" may be used for hysteresis, smoothing, or another operation performed by a device that includes a decoder, such as the decoder 110 of FIG. 1 or the decoder 210 of FIG. 2.

A frame of an encoded signal may be received by a device that includes a decoder, such as the decoder 110 of FIG. 1 or the decoder 210 of FIG. 2. The frame may be classified as speech or music as indicated in Example 1.

```
/* A frame of an encoded audio signal is received and one or more parameters included
in the frame may be identified, such as core, coder type, and pitch. The
"lp_coder_type" and "d_lp_core" corresponding to the frame are determined.*/
st->lp_coder_type = α1*st->lp_coder_type + (1- α1) * abs(coder_type);
st->d_lp_core = β1 * st->d_lp_core + (1-β1) * st->core;
/* A decision tree is used to classify the frame */
if (st->d_lp_core < Th1) /*Th1 is a first threshold*/
{
    if (st->lp_coder_type < Th2 ) /*Th2 is a second threshold*/
    {
        st->dec_spmu = 1; /*The frame is classified as music*/
        p1 = first_value; /*first probability (e.g., first confidence value)*/
    }
    else
    {
        if (st->lp_pitch_stab < TH3 ) /*Th3 is a third threshold*/
        {
            if (st->d_lp_core < TH4 ) /*Th4 is a fourth threshold*/
            {
                st->dec_spmu = 0;
                p1 = second_value; /*second probability*/;
            }
```

-continued

```
                    else
                    {
                        if (st->lp_coder_type < Th5 ) /*Th5 is a fifth threshold*/
                        {
                            if (st->d_lp_snr < Th6 ) /*Th6 is a
                                                    sixth threshold*/
                            {
                                st->dec_spmu = 1;
                                p1= third_value; /*third probability*/
                            }
                            else
                            {
                                if (st->d_lp_core < Th7 ) /*Th7 is a
                                                    seventh threshold*/
                                {
                                    st->dec_spmu = 0;
                                    p1 = fourth_value; /*fourth
                                                    probability*/
                                }
                                else
                                {
                                    st->dec_spmu = 1;
                                    p1 = fifth_value; /*fifth
                                                    probability*/
                                }
                            }
                        }
                        else
                        {
                            if (st->d_lp_snr < Th8 ) /*Th8 is an
                                                    eighth_threshold*/
                            {
                                st->dec_spmu = 0;
                                p1 = sixth_value; /*sixth probability*/
                            }
                            else
                            {
                                st->dec_spmu = 1;
                                p1 = seventh_value; /*seventh
                                                    probability*/
                            }
                        }
                    }
                }
                else
                {
                    if (st->d_lp_core < Th9) /*Th9 is a ninth threshold*/
                    {
                        st->dec_spmu = 0;
                        p1 = eighth_value; /*eighth probability*/
                    }
                    else
                    {
                        if (st->d_lp_core < Th10) /*Th10 is a tenth threshold*/
                        {
                            st->dec_spmu = 0;
                            p1 = ninth_value; /*ninth probability*/
                        }
                        else
                        {
                            if (st->d_lp_snr <Th11 ) /*Th11 is an
                                                    eleventh threshold*/
                            {
                                st->dec_spmu = 1;
                                p1 = tenth_value; /*tenth probability*/
                            }
                            else
                            {
                                st->dec_spmu = 0;
                                p1 = eleventh_value; /*eleventh
                                                    probability*/
                            }
                        }
                    }
                }
            }
        }
```

-continued

```
else
{
        if ( st->d_lp_core < Th12 ) /*Th12 is a twelfth threshold*/
        {
                if ( st->d_lp_snr < Th13 ) /*Th13 is a thirteenth threshold*/
                {
                        st->dec_spmu = 0;
                        p1 = twelfth_value; /*twelfth probability*/
                }
                else
                {
                        st->dec_spmu = 1;
                        p1 = thirteenth_value; /*thirteenth probability*/
                }
        }
        else
        {
                st->dec_spmu = 1;
                p1 = fourteenth_value; /*fourteenth probability*/
        }
}
```

EXAMPLE 1

After a frame is classified, hysteresis may be performed based on the classification of the frame as indicated in Example 2.

```
if ( st->dec_spmu == 1 ) /*frame was classified as music by decision tree*/
{
        if ( st->sp_hist == 0 ) /*speech decision history countdown counter has reached
0*/
        {
        st->dec_spmu = 1; /*classify frame as music*/
        st->mu_hist = H1; /*reset music decision history countdown counter to H1,
                                where H1 is a first positive integer*/
        }
        else /*speech decision history countdown counter has not yet reached 0 –
continue classifying as speech*/
        {
        st->dec_spmu = 0; /*reclassify frame as speech*/
        st->sp_hist -= 1; /*decrement speech decision history countdown counter*/
        }
{
else /*frame was classified as speech by decision tree*/
{
        if ( st->mu_hist == 0 ) /*music decision history countdown counter has reached
0*/
        {
        st->dec_spmu = 0; /*classify frame as speech*/
        st->sp_hist = H2; /*reset speech decision history countdown counter to H2,
                                where H2 is a second positive integer. In some
                                implementations, H1 and H2 are the same value.*/
        }
        else
        {
        st->dec_spmu = 1; /*reclassify frame as music*/
        st->mu_hist -= 1; /*decrement music decision history countdown counter*/
        }
}
```

EXAMPLE 2

Figure 3:
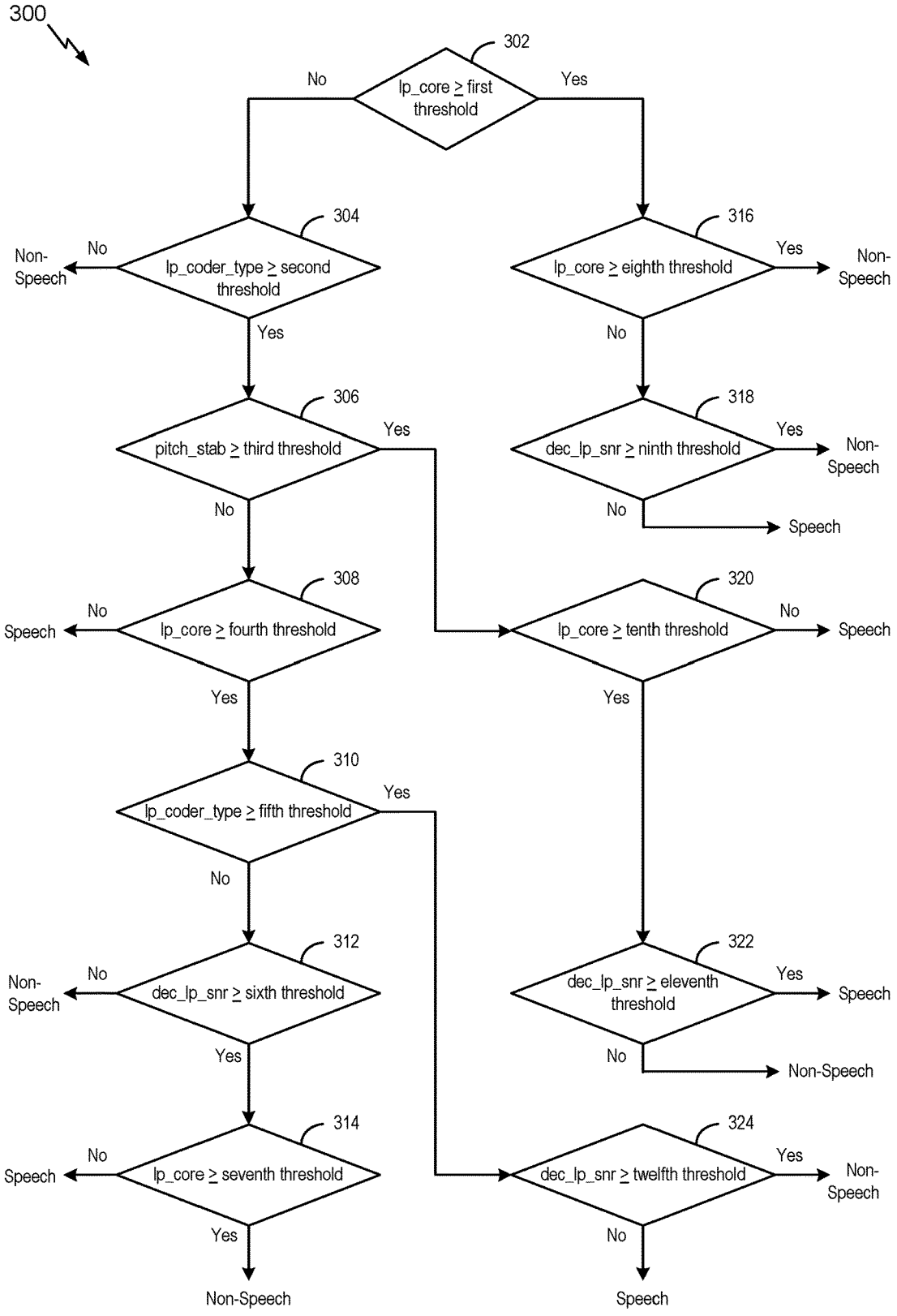
FIG. 3 is a flow chart illustrating a method of classifying an audio signal.

FIG. 3 is a flow chart illustrating a method 300 of classifying an audio signal, such as an audio frame of an audio signal. The method 300 may be performed by the decoder 110, the classifier 120 of FIG. 1, the decoder 210, the classifier 240, or the decision generator 242 of FIG. 2.

The method 300 may include determining whether a core parameter (indicated as "lp_core") is greater than or equal to a first threshold, at 302. If the core parameter is greater than or equal to the first threshold, the method 300 may advance to 316. Alternatively, if the core parameter is less than the first threshold, the method 300 may advance to 304. Although described as being greater than (or less than) a threshold, the determining described with reference to FIG. 3 may indicate whether a parameter has a particular value. For example, if the core parameter indicates a first core type using a "0" value and a second core type using a "1" value, determining that the core parameter is greater than or equal to a threshold e.g., "1"_may indicate that the core parameter indicates the second core type.

At 304, the method 300 may include determining whether a coder type parameter (indicated as "lp_coder_type") is greater than or equal to a second threshold. If the coder type parameter is less than the second threshold, the method 300 may indicate that a synthesized signal is classified as a non-speech signal (e.g., a music signal). The synthesized signal may include or correspond to the synthesized signal 118 of FIG. 1 or the synthesized signal 230 of FIG. 2. Alternatively, if the coder type parameter is greater than or equal to the second threshold, the method 300 may advance to 306.

The method 300 may include determining whether a pitch stability parameter (indicated as "pitch_stab") is greater than or equal to a third threshold, at 306. If the pitch stability parameter is greater than or equal to the third threshold, the method 300 may advance to 320. Alternatively, if the pitch stability parameter is less than the third threshold, the method 300 may advance to 308.

At 308, the method 300 may include determining whether the core parameter is greater than or equal to a fourth threshold. If the core parameter is less than the fourth threshold, the method 300 may indicate that the synthesized signal is classified as a speech signal. Alternatively, if the core parameter is greater than or equal to the fourth threshold, the method 300 may advance to 310.

The method 300 may include determining whether the coder type parameter (indicated as "lp_coder_type") is greater than or equal to a fifth threshold, at 310. If the coder type parameter is greater than or equal to the fifth threshold, the method 300 may advance to 324. Alternatively, if the coder type parameter is less than the fifth threshold, the method 300 may advance to 312.

At 312, the method 300 may include determining whether a signal-to-noise ratio (SNR) parameter (indicated as "dec_lp_snr") is greater than or equal to a sixth threshold. If the SNR parameter is less than the sixth threshold, the method 300 may indicate that the synthesized signal is classified as a non-speech signal (e.g., a music signal). Alternatively, if the SNR parameter is greater than or equal to the sixth threshold, the method 300 may advance to 314.

The method 300 may include determining whether the core parameter is greater than or equal to a seventh threshold, at 314. If the core parameter is less than the seventh threshold, the method 300 may indicate that the synthesized signal is classified as a speech signal. Alternatively, if the core parameter is greater than or equal to the seventh threshold, the method 300 may indicate that the synthesized signal is classified as a non-speech signal (e.g., a music signal).

At 316, the method 300 may include determining whether the core parameter is greater than or equal to an eighth threshold. If the core parameter is greater than or equal to the eighth threshold, the method 300 may indicate that the synthesized signal is classified as a non-speech signal (e.g., a music signal). Alternatively, if the core parameter is less than the eighth threshold, the method 300 may advance to 318.

The method 300 may include determining whether the SNR parameter is greater than or equal a ninth threshold, at 318. If the SNR parameter is less than the ninth threshold, the method 300 may indicate that the synthesized signal is classified as a speech signal. Alternatively, if the SNR parameter is greater than or equal to the ninth threshold, the method 300 may indicate that the synthesized signal is classified as a non-speech signal (e.g., a music signal).

At 320, the method 300 may include determining whether the core parameter is greater than or equal to a tenth threshold. If the core parameter is less than the tenth threshold, the method 300 may indicate that the synthesized signal is classified as a speech signal. Alternatively, if the core parameter is greater than or equal to the tenth threshold, the method 300 may advance to 322.

The method 300 may include determining whether the SNR parameter is greater than or equal to an eleventh threshold, at 322. If the SNR parameter is less than the eleventh threshold, the method 300 may indicate that the synthesized signal is classified as a non-speech signal (e.g., a music signal). Alternatively, if the SNR parameter is greater than or equal to the eleventh threshold, the method 300 may indicate that the synthesized signal is classified as a speech signal.

At 324, the method 300 may include determining whether the SNR parameter is greater than or equal to a twelfth threshold. If the SNR parameter is less than the twelfth threshold, the method 300 may indicate that the synthesized signal is classified as a speech signal. Alternatively, if the SNR parameter is greater than or equal to the twelfth threshold, the method 300 may indicate that the synthesized signal is classified as a non-speech signal (e.g., a music signal).

In some implementations, one or more operations described with reference to the method 300 may be optional, may be performed at least partially concurrently, may be modified, may be performed in a different order than shown or described, or a combination thereof. For example, the method 300 may be modified so that, at 302, if the core parameter is less than the first threshold, the modified method may indicate that the synthesized signal is classified as a speech signal. Accordingly, the modified method would only use the core parameter (lp_core). As another example, although time-averaged (low pass) parameters (indicated by "lp") have been described, the method 300 could use one or more parameters extracted from an encoded bit stream (e.g., core, coder_type, pitch, etc.) in place of a time-averaged or low pass parameter. Although the method 300 has been described with reference to one or more thresholds, two or more of the thresholds may have the same value or may have different values. Additionally, the parameter indications are for illustration only. In other implementations, the parameters may be indicated by different names. For example, the SNR parameter may be indicated by "d_l_snr".

Thus, the method 300 may be used to classify the synthesized signal (corresponding to a particular audio frame). For example, the synthesized signal may be classified based on at least one parameter associated with (e.g., determined from) the encoded audio signal (e.g., the particular audio frame), at least one parameter determined based on the synthesized signal (e.g., a portion of the synthesized signal that corresponds to the particular audio frame), or a combination thereof. By using the at least one parameter associated with the encoded audio signal, classifying the synthesized signal may be less computationally complex as compared to conventional classification techniques.

Figure 4:
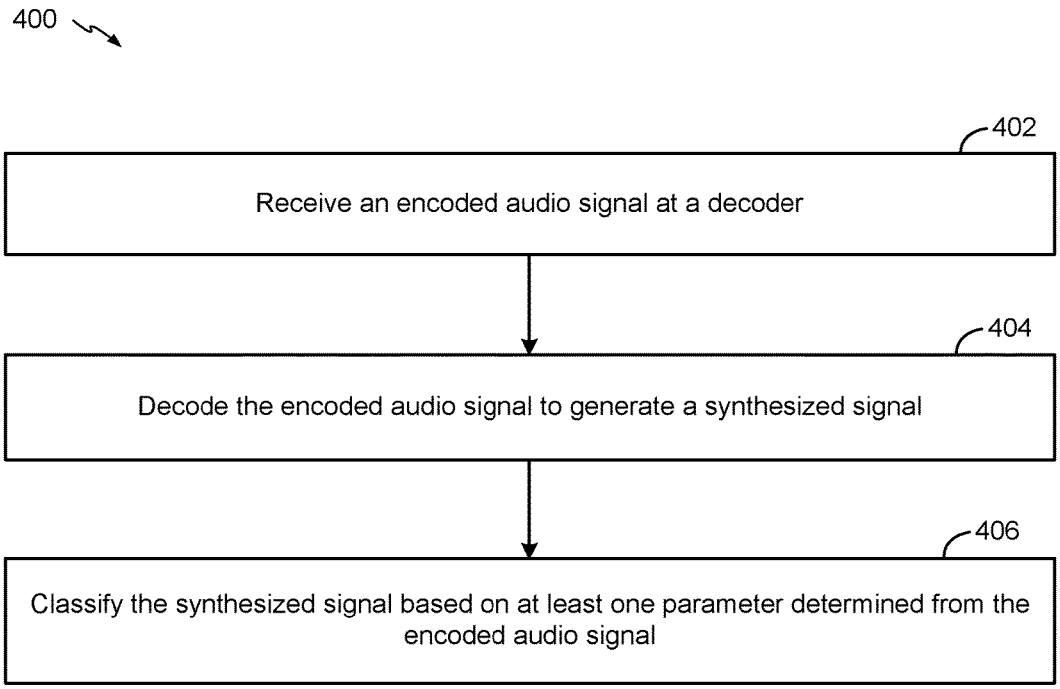
FIG. 4 is a flow chart illustrating a method of processing an audio signal.

FIG. 4 is a flow chart illustrating a method 400 of processing an audio signal, such as an encoded audio signal. The method 400 may be performed at a device, such as a device that includes the system 100 of FIG. 1 or the system 200 of FIG. 2. For example, the method 400 may be performed at a device that includes a decoder, such as the decoder 110 of FIG. 1 or the decoder 210 of FIG. 2.

The method 400 includes receiving an encoded audio signal at a decoder, at 402. For example, the encoded audio signal may include or correspond to the encoded audio signal 102 of FIG. 1 or the encoded audio signal 202 of FIG. 2. The encoded audio signal may be received at a decoder, such as the decoder 110 of FIG. 1 or the decoder 210 of FIG. 2. The encoded audio signal may include (or indicate) one or more parameters that were determined by an encoder that generated the encoded audio signal. Additionally or alternatively, the encoded audio signal may include one or more values used to generate one or more parameters.

The method 400 also includes decoding the encoded audio signal to generate a synthesized signal, at 404. For example, the encoded audio signal may be decoded by the decoder 110 of FIG. 1, the decoder 210, the LPC mode decoder 214, the transform mode decoder 216, or the DTX/CNG 218. The synthesized signal may include or correspond to the synthesized signal 118 of FIG. 1 or the synthesized signal 230 of FIG. 2.

The method 400 further includes classifying the synthesized signal based on at least one parameter determined from the encoded audio signal, at 406. For example, the at least one parameter determined from the encoded audio signal may include or correspond to the at least one parameter 112 of FIG. 1 or the at least one parameter 250 of FIG. 2. The at least one parameter may be based on one or more parameters included in a bit stream, such as a core indicator, a coding mode, a coder type, or a pitch (e.g., an instantaneous pitch). Classifying the synthesized signal may be performed by the classifier 120 of FIG. 1, the classifier 240, the decision generator 242 of FIG. 2, or a combination thereof. In some implementations, classifying the synthesized signal may be performed on a frame-by-frame basis. The synthesized signal may be classified as a speech signal, a non-speech signal, a music signal, a noisy speech signal, a background noise signal, or a combination thereof. In some implementations, a speech signal classification may include clean speech signals, noisy speech signals, inactive speech signals, or a combination thereof. In some implementations, a music signal classification may include non-speech signals. The at least one parameter determined from the encoded audio signal may include a parameter included in (or indicated by) the encoded audio signal, a parameter derived from one or more parameters included in the encoded audio signal, or a combination thereof.

In some implementations, the method 400 may include determining the at least one parameter at the decoder. For example, the decoder 110 may extract the at least one parameter 112 from the encoded audio signal 102, as described with reference to FIG. 1. In a particular implementation, the decoder 110 may extract the at least one parameter 112 prior to decoding the encoded audio signal 102. Additionally or alternatively, the decoder 110 may extract a set of values from the encoded audio signal 102 and the decoder 110 may calculate the at least one parameter 112 using the set of values. In a particular implementation, the decoder 110 may extract the set of values from the encoded audio signal 102, calculate the at least one parameter 112 based on the set of values, or both, during decoding of the encoded audio signal 102. The at least one parameter may include a core indicator, a coding mode, a coder type, a low pass core decision, a pitch value, a pitch stability, or a combination thereof. The coding mode may include an algebraic code-excited linear prediction (ACELP), a transform coded excitation (TCX), or a modified discrete cosine transform (MDCT), as illustrative, non-limiting examples. The coder type may include voiced coding, unvoiced coding, music coding, or transient coding, as illustrative, non-limiting examples.

In some implementations, classifying the synthesized signal may be further based on at least one parameter determined based on the synthesized signal. For example, the method 400 may include calculating the at least one parameter determined based on the synthesized signal. The at least one parameter determined based on the synthesized signal may include or correspond to the parameter 114 of FIG. 1 or the parameter 254 of FIG. 2. The at least one parameter determined based on the synthesized signal may include a signal-to-noise ratio, a zero crossing, an energy distribution, an energy compaction, a signal harmonicity, or a combination thereof, as illustrative, non-limiting examples. The at least one parameter determined based on the synthesized signal may be calculated from (e.g., by processing) the synthesized signal, as described with reference to FIGS. 1 and 2. In a particular implementation, the at least one parameter is a signal-to-noise ratio of the synthesized signal.

In some implementations, the method 400 may include selectively changing an operating state of a noise suppressor based on classifying the synthesized signal. For example, the method 400 may include disabling the noise suppressor in response to classifying the synthesized signal as the non-speech signal. As another example, the method 400 may include activating the noise suppressor in response to classifying the synthesized signal as the speech signal.

In some implementations, the method 400 may include outputting an indication of a classification of the synthesized signal. For example, the classifier 120 may output the classification 119 to the post processor 130 via the control signal 122, as described with reference to FIG. 1. As another example, the classifier 120 may output the classification 119 to the post processor 130 via the control signal 122, as described with reference to FIG. 2. The method 400 may also include selectively processing, based on the indication, the synthesized signal to generate an audio signal. For example, the level adjuster 134, the acoustic filter 136, the range compressor 138, or a combination thereof, may selectively process the synthesized signal 118 (or a version thereof) to generate the audio signal 140 output by the post processor 130.

Thus, the method 400 may be used to classify the synthesized signal (corresponding to a particular audio frame). For example, the synthesized signal may be classified based on at least one parameter determined from the encoded audio signal (e.g., the particular audio frame). By using the at least one parameter determined from the encoded audio signal, classifying the synthesized signal may be less computationally complex as compared to conventional classification techniques.

The methods of FIGS. 3-4 (or the Examples 1-2) may be implemented by a FPGA device, an ASIC, a processing unit such as a central processing unit (CPU), a DSP, a controller, another hardware device, firmware device, or any combination thereof. As an example, a portion of one of the methods FIGS. 3-4 (or the Examples 1-2) may be combined with a second portion of one of the methods of FIGS. 3-4 (or the Examples 1-2). Additionally, one or more operations described with reference to the FIGS. 3-4 may be optional, may be performed at least partially concurrently, may be performed in a different order than shown or described, or a combination thereof. As another example, one or more of the methods of FIGS. 3-4 (or the Examples 1-2), individually or in combination, may be performed by a processor that executes instructions, as described with respect to FIGS. 5-6.

Figure 5:
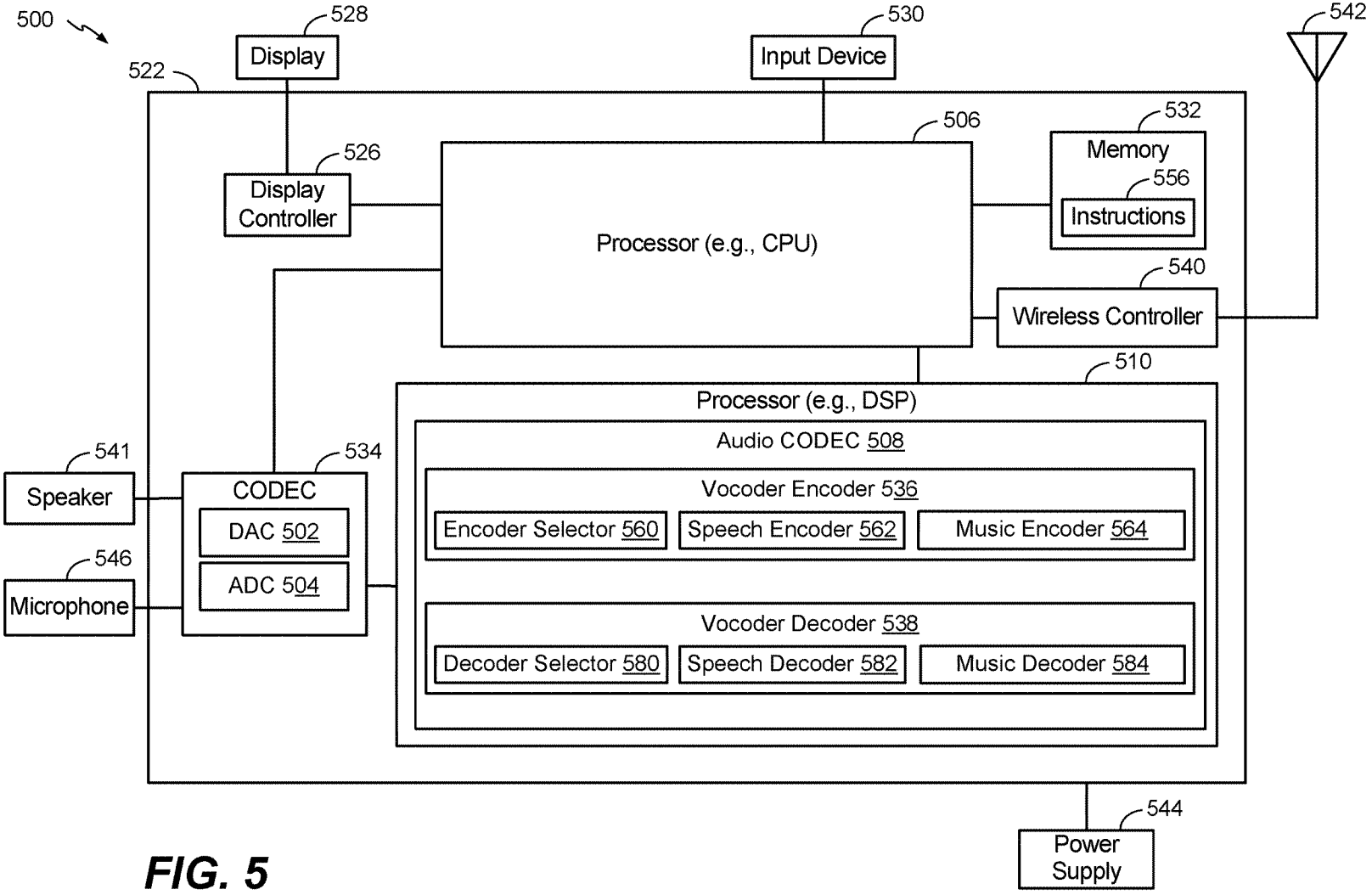
FIG. 5 is a block diagram of an illustrative device that is operable to support various aspects of one or more methods, systems, apparatuses, computer-readable media, or a combination thereof, disclosed herein.

Referring to FIG. 5, a block diagram of a particular illustrative example of a device 500 (e.g., a wireless communication device) is depicted. In various implementations, the device 500 may have more or fewer components than illustrated in FIG. 5. In an illustrative example, the device 500 may include the system 100 of FIG. 1, the system 200 of FIG. 2, or a combination thereof. In an illustrative example, the device 500 may operate according to one or more of the methods of FIGS. 3-4, one or more of the Examples 1-2, or a combination thereof.

In a particular example, the device 500 includes a processor 506 (e.g., a CPU). The device 500 may include one or more additional processors, such as a processor 510 (e.g., a DSP). The processor 510 may include an audio coder-decoder (CODEC) 508. For example, the processor 510 may include one or more components (e.g., circuitry) configured to perform operations of the audio CODEC 508. As another example, the processor 510 may be configured to execute one or more computer-readable instructions to perform the operations of the audio CODEC 508. Although the audio CODEC 508 is illustrated as a component of the processor 510, in other examples one or more components of the audio CODEC 508 may be included in the processor 506, a CODEC 534, another processing component, or a combination thereof.

The audio CODEC 508 may include a vocoder encoder 536, a vocoder decoder 538, or both. The vocoder encoder 536 may include an encode selector 560, a speech encoder 562, and a music encoder 564. The vocoder decoder 538 may include or correspond to the decoder 110 of FIG. 1 or the decoder 210 of FIG. 2. The vocoder decoder 538 may include a decode selector 580, a speech decoder 582, and a music decoder 584, and may also include a classifier, such as the classifier 120 of FIG. 1, the classifier 240 of FIG. 2, or both. For example, the speech decoder 582 may correspond to the LPC mode decoder 214 of FIG. 2, the music decoder 584 may correspond to the transform mode decoder 216 of FIG. 2, and the decode selector 580 may correspond to the switch 212 of FIG. 2.

The device 500 may include a memory 532 and a CODEC 534. The memory 532, such as a computer-readable storage device, may include instructions 556. The instructions 556 may include one or more instructions that are executable by the processor 506, the processor 510, or both to perform one or more of the methods of FIGS. 3-4. The device 500 may include a wireless controller 540 coupled (e.g., via a transceiver) to an antenna 542. In some implementations, the device 500 may include a transceiver (not shown). The transceiver may include one or more transmitters, one or more receivers, or a combination thereof. The transceiver may be coupled to the antenna 542 and to the wireless controller 540. For example, the transceiver may be included in the wireless controller 540. In other implementations, the transceiver (or a portion thereof) may be separate from the wireless controller 540.

The device 500 may include a display 528 coupled to a display controller 526. A speaker 541, a microphone 546, or both, may be coupled to the CODEC 534. In some implementations the device 500 may include multiple speakers, such as the speaker 541. The CODEC 534 may include a digital-to-analog converter 502 and an analog-to-digital converter 504. The CODEC 534 may receive analog signals from the microphone 546, convert the analog signals to digital signals using the analog-to-digital converter 504, and provide the digital signals to the audio CODEC 508. The audio CODEC 508 may process the digital signals. In some implementations, the audio CODEC 508 may provide digital signals to the CODEC 534. The CODEC 534 may convert the digital signals to analog signals using the digital-to-analog converter 502 and may provide the analog signals to the speaker 541.

The vocoder decoder 538 may use a hardware implementation of decoder-side classification, such as dedicated circuitry configured to generate a classification of an encoded signal as described with respect to FIGS. 1-4 and Examples 1-2. Alternatively, or in addition, a software implementation (or combined software/hardware implementation) may be implemented. For example, the instructions 556 may be executable by the processor 510 or other processing unit of the device 500 (e.g., the processor 506, the CODEC 534, or both). To illustrate, the instructions 556 may correspond to operations described as being performed with respect to the classifier 120 of FIG. 1.

In a particular implementation, the device 500 may be included in a system-in-package or system-on-chip device 522. In a particular implementation, the memory 532, the processor 506, the processor 510, the display controller 526, the CODEC 534, and the wireless controller 540 are included in a system-in-package or system-on-chip device 522. In a particular implementation, an input device 530 and a power supply 544 are coupled to the system-on-chip device 522. Moreover, in a particular implementation, as illustrated in FIG. 5, the display 528, the input device 530, the speaker 541, the microphone 546, the antenna 542, and the power supply 544 are external to the system-on-chip device 522. In a particular implementation, each of the display 528, the input device 530, the speaker 541, the microphone 546, the antenna 542, and the power supply 544 may be coupled to a component of the system-on-chip device 522, such as an interface or a controller.

The device 500 may include a communication device, an encoder, a decoder, a transcoder, a smart phone, a cellular phone, a mobile communication device, a laptop computer, a computer, a tablet, a personal digital assistant (PDA), a set top box, a video player, an entertainment unit, a display device, a television, a gaming console, a music player, a radio, a digital video player, a digital video disc (DVD) player, a tuner, a camera, a navigation device, a vehicle, a base station, or a combination thereof.

In an illustrative implementation, the processor 510 may be operable to perform all or a portion of the methods or operations described with reference to FIGS. 1-4, the Examples 1-2, or a combination thereof. For example, the microphone 546 may capture an audio signal corresponding to a user speech signal. The analog-to-digital converter 504 may convert the captured audio signal from an analog waveform into a digital waveform that includes digital audio samples. The processor 510 may process the digital audio samples.

The device 500 may therefore include a computer-readable storage device (e.g., the memory 532) storing instructions (e.g., the instructions 556) that, when executed by a processor (e.g., the processor 506 or the processor 510), cause the processor to perform operations including decoding an encoded audio signal to generate a synthesized signal. The encoded audio signal may include or correspond to the encoded audio signal 102 of FIG. 1 or the encoded audio signal 202 of FIG. 2. The synthesized signal may include or correspond to the synthesized signal 118 of FIG. 1 or the synthesized signal 230 of FIG. 2. The operations may also include classifying the synthesized signal based on at least one parameter determined from the encoded audio signal.

In some implementations, the synthesized signal may also be classified based in part on at least one parameter determined based on the synthesized signal, such as a signal-to-noise ratio. In some implementations, the operations may also include selectively performing noise suppression on the synthesized signal based on a classification of the synthesized signal as the speech signal or the music signal. In a particular implementation, the synthesized signal is further classified based on a parameter derived from one or more parameters in the encoded audio signal, such as pitch stability.

Figure 6:
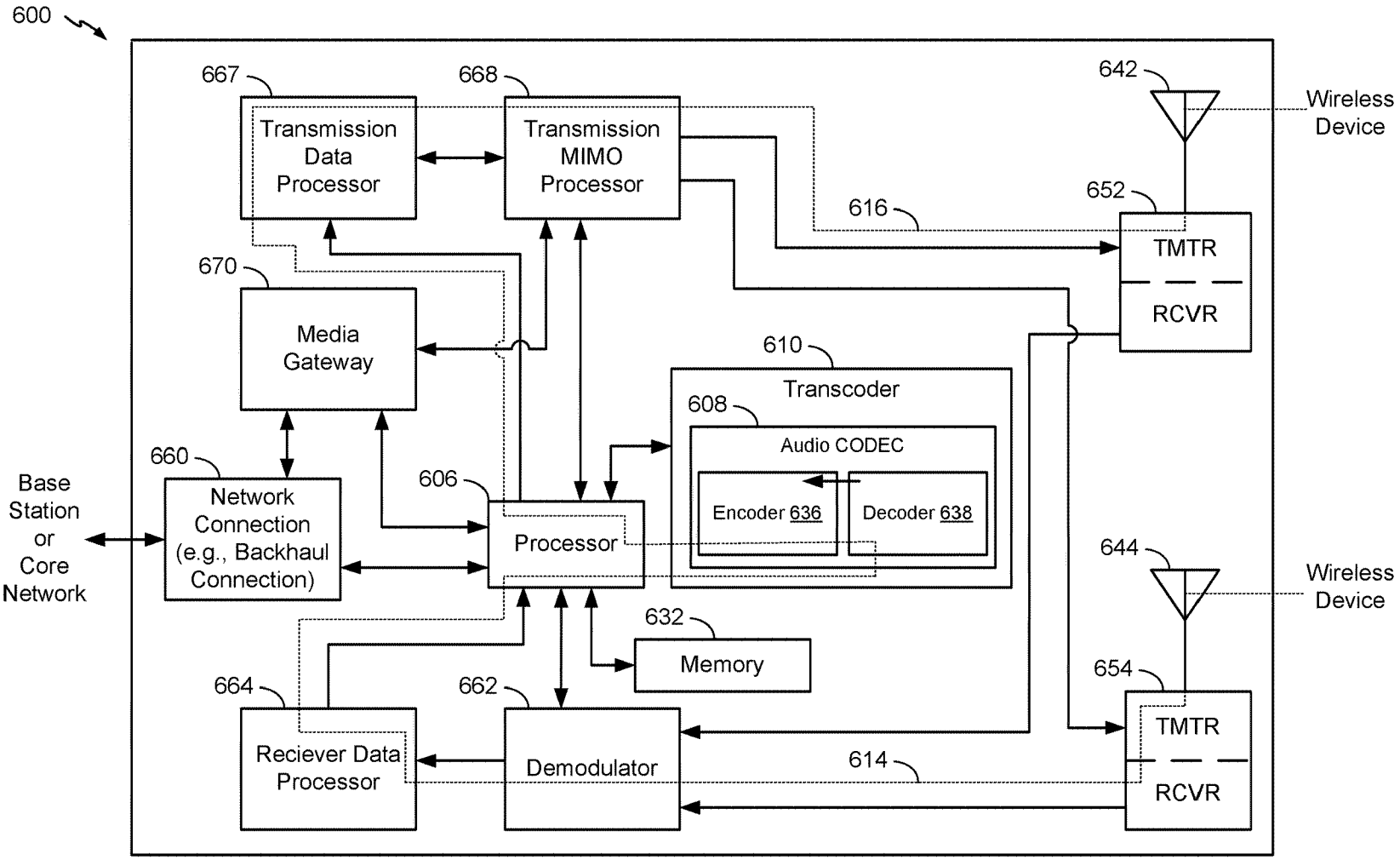
FIG. 6 is a block diagram of a base station that is operable to support various aspects of one or more methods, systems, apparatuses, computer-readable media, or a combination thereof, disclosed herein.

Referring to FIG. 6, a block diagram of a particular illustrative example of a base station 600 is depicted. In various implementations, the base station 600 may have more components or fewer components than illustrated in FIG. 6. In an illustrative example, the base station 600 may include the system 100 of FIG. 1. In an illustrative example, the base station 600 may operate according to one or more of the methods of FIGS. 3-4, one or more of the Examples 1-2, or a combination thereof.

The base station 600 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 500 of FIG. 5.

Various functions may be performed by one or more components of the base station 600 (and/or in other components not shown), such as sending and receiving messages and data (e.g., audio data). In a particular example, the base station 600 includes a processor 606 (e.g., a CPU). The base station 600 may include a transcoder 610. The transcoder 610 may include an audio 608 CODEC. For example, the transcoder 610 may include one or more components (e.g., circuitry) configured to perform operations of the audio CODEC 608. As another example, the transcoder 610 may be configured to execute one or more computer-readable instructions to perform the operations of the audio CODEC 608. Although the audio CODEC 608 is illustrated as a component of the transcoder 610, in other examples one or more components of the audio CODEC 608 may be included in the processor 606, another processing component, or a combination thereof. For example, a vocoder decoder 638 may be included in a receiver data processor 664. As another example, a vocoder encoder 636 may be included in a transmission data processor 667.

The transcoder 610 may function to transcode messages and data between two or more networks. The transcoder 610 may be configured to convert message and audio data from a first format (e.g., a digital format) to a second format. To illustrate, the vocoder decoder 638 may decode encoded signals having a first format and the vocoder encoder 636 may encode the decoded signals into encoded signals having a second format. Additionally or alternatively, the transcoder 610 may be configured to perform data rate adaptation. For example, the transcoder 610 may downconvert a data rate or upconvert the data rate without changing a format the audio data. To illustrate, the transcoder 610 may downconvert 64 kbit/s signals into 16 kbit/s signals.

The audio CODEC 608 may include the vocoder encoder 636 and the vocoder decoder 638. The vocoder encoder 636 may include an encode selector, a speech encoder, and a music encoder, as described with reference to FIG. 5. The vocoder decoder 638 may include a decoder selector, a speech decoder, and a music decoder.

The base station 600 may include a memory 632. The memory 632, such as a computer-readable storage device, may include instructions. The instructions may include one or more instructions that are executable by the processor 606, the transcoder 610, or a combination thereof, to perform one or more of the methods of FIGS. 3-4, the Examples 1-2, or a combination thereof. The base station 600 may include multiple transmitters and receivers (e.g., transceivers), such as a first transceiver 652 and a second transceiver 654, coupled to an array of antennas. The array of antennas may include a first antenna 642 and a second antenna 644. The array of antennas may be configured to wirelessly communicate with one or more wireless devices, such as the device 500 of FIG. 5. For example, the second antenna 644 may receive a data stream 614 (e.g., a bit stream) from a wireless device. The data stream 614 may include messages, data (e.g., encoded speech data), or a combination thereof.

The base station 600 may include a network connection 660, such as backhaul connection. The network connection 660 may be configured to communicate with a core network or one or more base stations of the wireless communication network. For example, the base station 600 may receive a second data stream (e.g., messages or audio data) from a core network via the network connection 660. The base station 600 may process the second data stream to generate messages or audio data and provide the messages or the audio data to one or more wireless device via one or more antennas of the array of antennas or to another base station via the network connection 660. In a particular implementation, the network connection 660 may be a wide area network (WAN) connection, as an illustrative, non-limiting example. In some implementations, the core network may include or correspond to a Public Switched Telephone Network (PSTN), a packet backbone network, or both.

The base station 600 may include a media gateway 670 that is coupled to the network connection 660 and the processor 606. The media gateway 670 may be configured to convert between media streams of different telecommunications technologies. For example, the media gateway 670 may convert between different transmission protocols, different coding schemes, or both. To illustrate, the media gateway 670 may convert from PCM signals to Real-Time Transport Protocol (RTP) signals, as an illustrative, non-limiting example. The media gateway 670 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 670 may include a transcoder, such as the transcoder 610, and may be configured to transcode data when codecs are incompatible. For example, the media gateway 670 may transcode between an Adaptive Multi-Rate (AMR) codec and a G.711 codec, as an illustrative, non-limiting example. The media gateway 670 may include a router and a plurality of physical interfaces. In some implementations, the media gateway 670 may also include a controller (not shown). In a particular implementation, the media gateway controller may be external to the media gateway 670, external to the base station 600, or both. The media gateway controller may control and coordinate operations of multiple media gateways. The media gateway 670 may receive control signals from the media gateway controller and may function to bridge between different transmission technologies and may add service to end-user capabilities and connections.

The base station 600 may include a demodulator 662 that is coupled to the transceivers 652, 654, the receiver data processor 664, and the processor 606, and the receiver data processor 664 may be coupled to the processor 606. The demodulator 662 may be configured to demodulate modulated signals received from the transceivers 652, 654 and to provide demodulated data to the receiver data processor 664. The receiver data processor 664 may be configured to extract a message or audio data from the demodulated data and send the message or the audio data to the processor 606.

The base station 600 may include a transmission data processor 667 and a transmission multiple input-multiple output (MIMO) processor 668. The transmission data processor 667 may be coupled to the processor 606 and the transmission MIMO processor 668. The transmission MIMO processor 668 may be coupled to the transceivers 652, 654 and the processor 606. In some implementations, the transmission MIMO processor 668 may be coupled to the media gateway 670. The transmission data processor 667 may be configured to receive the messages or the audio data from the processor 606 and to code the messages or the audio data based on a coding scheme, such as CDMA or orthogonal frequency-division multiplexing (OFDM), as an illustrative, non-limiting examples. The transmission data processor 667 may provide the coded data to the transmission MIMO processor 668.

The coded data may be multiplexed with other data, such as pilot data, using CDMA or OFDM techniques to generate multiplexed data. The multiplexed data may then be modulated (i.e., symbol mapped) by the transmission data processor 667 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 606.

The transmission MIMO processor 668 may be configured to receive the modulation symbols from the transmission data processor 667 and may further process the modulation symbols and may perform beamforming on the data. For example, the transmission MIMO processor 668 may apply beamforming weights to the modulation symbols. The beamforming weights may correspond to one or more antennas of the array of antennas from which the modulation symbols are transmitted.

During operation, the second antenna 644 of the base station 600 may receive a data stream 614. The second transceiver 654 may receive the data stream 614 from the second antenna 644 and may provide the data stream 614 to the demodulator 662. The demodulator 662 may demodulate modulated signals of the data stream 614 and provide demodulated data to the receiver data processor 664. The receiver data processor 664 may extract audio data from the demodulated data and provide the extracted audio data to the processor 606.

The processor 606 may provide the audio data to the transcoder 610 for transcoding. The vocoder decoder 638 of the transcoder 610 may decode the audio data from a first format into decoded audio data and the vocoder encoder 636 may encode the decoded audio data into a second format. In some implementations, the vocoder encoder 636 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 610, the transcoding operations (e.g., decoding and encoding) may be performed by multiple components of the base station 600. For example, decoding may be performed by the receiver data processor 664 and encoding may be performed by the transmission data processor 667. In other implementations, the processor 606 may provide the audio data to the media gateway 670 for conversion to another transmission protocol, coding scheme, or both. The media gateway 670 may provide the converted data to another base station or core network via the network connection 660.

The vocoder decoder 638, the vocoder encoder 636, or both may receive the parameter data and may identify the parameter data on a frame-by-frame basis. The vocoder decoder 638, the vocoder encoder 636, or both may classify, on a frame-by-frame basis, the synthesized signal based on the parameter data. The synthesized signal may be classified as a speech signal, a non-speech signal, a music signal, a noisy speech signal, a background noise signal, or a combination thereof. The vocoder decoder 638, the vocoder encoder 636, or both may select a particular decoder, encoder, or both based on the classification. Encoded audio data generated at the vocoder encoder 636, such as transcoded data, may be provided to the transmission data processor 667 or the network connection 660 via the processor 606.

The transcoded audio data from the transcoder 810 may be provided to the transmission data processor 667 for coding according to a modulation scheme, such as OFDM, to generate the modulation symbols. The transmission data processor 667 may provide the modulation symbols to the transmission MIMO processor 668 for further processing and beamforming. The transmission MIMO processor 668 may apply beamforming weights and may provide the modulation symbols to one or more antennas of the array of antennas, such as the first antenna 642 via the first transceiver 652. Thus, the base station 600 may provide a transcoded data stream 616, that corresponds to the data stream 614 received from the wireless device, to another wireless device. The transcoded data stream 616 may have a different encoding format, data rate, or both, than the data stream 614. In other implementations, the transcoded data stream 616 may be provided to the network connection 660 for transmission to another base station or a core network.

The base station 600 may therefore include a computer-readable storage device (e.g., the memory 632) storing instructions that, when executed by a processor (e.g., the processor 606 or the transcoder 610), cause the processor to perform operations including decoding an encoded audio signal to generate a synthesized signal. The operations may also include classifying the synthesized signal based on at least one parameter determined from the encoded audio signal.

In conjunction with the described aspects, an apparatus may include means for receiving an encoded audio signal. For example, the means for receiving may include the decoder 110 of FIG. 1, the decoder 210, the switch 212 of FIG. 2, the antenna 542, the wireless controller 540, the processor 506 or the processor 510 executing the instructions 556 of FIG. 5, the vocoder decoder 538, the decode selector 580, the CODEC 534, the microphone 546 of FIG. 5, the first antenna 642, the second antenna 644, the first transceiver 652, the second transceiver 654, the processor 606 configured to execute instructions, the transcoder 610 of FIG. 6, one or more other devices, circuits, modules, or other instructions to receive the encoded audio signal, or any combination thereof.

The apparatus may include means for decoding the encoded audio signal to generate a synthesized signal. For example, the means for decoding may include the decoder 110 of FIG. 1, the decoder 210, the LPC mode decoder 214, the transform mode decoder 216, the DTX/CNG 218, the synthesized signal generator 220 of FIG. 2, the vocoder decoder 538, the speech decoder 582, the non-speech decode 548, the processor 506 or the processor 510 executing the instructions 556 of FIG. 5, the processor 606 configured to execute instructions, the transcoder 610 of FIG. 6, one or more other devices, circuits, modules, or other instructions to decode the encoded audio signal, or any combination thereof.

The apparatus may include means for classifying the synthesized signal based on at least one parameter determined from the encoded audio signal. For example, the means for classifying may include the decoder 110, the classifier 120 of FIG. 1, the decoder 210, the switch 212, the classifier 240, the decision generator 242 of FIG. 2, the decode selector 580, the processor 506 or the processor 510 executing the instructions 556 of FIG. 5, the processor 606 configured to execute instructions, the transcoder 610 of FIG. 6, one or more other devices, circuits, modules, or other instructions to classify the synthesized signal, or any combination thereof.

The means for receiving, the means for decoding, and the means for classifying may be integrated into a decoder, a set top box, a music player, a video player, an entertainment unit, a navigation device, a communications device, a PDA, a computer, or a combination thereof. In some implementations, the apparatus may include means for performing noise suppression on the synthesized signal based on a classification of the synthesized signal generated by the means for classifying. For example, the means for performing noise suppression may include the post processor 130, the noise suppressor 132 of FIG. 1, the processor 506 or the processor 510 executing the instructions 556 of FIG. 5, the processor 606 configured to execute instructions, the transcoder 610 of FIG. 6, one or more other devices, circuits, modules, or other instructions to perform noise suppression, or any combination thereof.

Although one or more of FIGS. 1-6 (and the Examples 1-2) may illustrate systems, apparatuses, methods, or a combination thereof according to the teachings of the disclosure, the disclosure is not limited to these illustrated systems, apparatuses, methods, or a combination thereof. One or more functions or components of any of FIGS. 1-6 (and the Examples 1-2), as illustrated or described herein, may be combined with one or more other portions of another of FIGS. 1-6 (and the Examples 1-2). Accordingly, no single aspect described herein should be construed as limiting and aspects of the disclosure may be suitably combined without departing form the teachings of the disclosure.

In the aspects of the description described herein, various functions performed by the system 100 of FIG. 1, the system 200 of FIG. 2, the device 500 of FIG. 5, the base station of FIG. 9 or a combination thereof, are described as being performed by certain circuitry or components. However, this division of circuitry or components is for illustration only. In alternate examples, a function performed by a particular circuit or components may instead be divided amongst multiple components or modules. Additionally or alternatively, two or more circuits or components of FIGS. 1, 2, 5 and 6 may be integrated into a single circuit or component. Each circuit or component illustrated in FIGS. 1, 2, 5, and 9 may be implemented using hardware (e.g., an ASIC, a DSP, a controller, a FPGA device, etc.), software (e.g., logic, modules, instructions executable by a processor, etc.), or any combination thereof.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be included directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient (e.g., non-transitory) storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

a decoder configured to receive an encoded audio signal representing an audio stream and including two or more parameters and to generate a synthesized signal based on the encoded audio signal; and a classifier configured to classify the synthesized signal based on the two or more parameters included in the encoded audio signal, wherein at least one parameter of the two or more parameters comprises a core indicator, a coding mode, a coder type, a low pass core decision, or a pitch value.

2. The device of claim 1, wherein the decoder is further configured to determine the two or more parameters included in the encoded audio signal, and wherein a second parameter of the two or more parameters comprises a core indicator, a coding mode, a coder type, or a low pass core decision.

3. The device of claim 1, wherein the classifier is further configured to classify the synthesized signal based on a parameter derived from the two or more parameters included in the encoded audio signal.

4. The device of claim 1, wherein the classifier is further configured to classify the synthesized signal based on at least one parameter determined based on the synthesized signal.

5. The device of claim 4, wherein the at least one parameter determined based on the synthesized signal comprises a signal-to-noise ratio, a zero crossing, an energy distribution, an energy compaction, a signal harmonicity, or a combination thereof.

6. The device of claim 1, wherein the decoder is further configured to extract the at least one parameter of the two or more parameters from the encoded audio signal prior to generating the synthesized signal.

7. The device of claim 1, wherein the decoder is further configured to:

extract a set of values from the encoded audio signal; and calculate a particular parameter based on the set of values.

8. The device of claim 1, wherein the classifier is configured to classify the synthesized signal as a speech signal, a non-speech signal, a music signal, a noisy speech signal, a background noise signal, or a combination thereof.

9. The device of claim 1, wherein the classifier is configured to classify the synthesized signal as a speech signal or a music signal and to generate an output that indicates a classification of the synthesized signal.

10. The device of claim 9, further comprising a noise suppressor configured to selectively perform noise suppression on the synthesized signal based on the classification, a confidence value, or both, wherein the noise suppressor is configured to deactivate or adjust noise suppression of the synthesized signal in response to the synthesized signal being classified as a music signal, determining that the confidence value is greater than or equal to a threshold, or both.

11. The device of claim 9, further comprising a noise suppressor, a level adjuster, an acoustic filter, a range compressor, or a combination thereof, configured to selectively process, based on the classification, the synthesized signal to generate an audio signal, wherein the noise suppressor is configured to perform noise suppression on the synthesized signal in response to the synthesized signal being classified as a speech signal.

12. The device of claim 1, wherein the decoder comprises a speech mode decoder and a music mode decoder, wherein the speech mode decoder comprises a linear predictive coding (LPC) mode decoder, and wherein the music mode decoder comprises a transform mode decoder.

13. The device of claim 1, further comprising:

an antenna; and a receiver coupled to the antenna and configured to receive the encoded audio signal.

14. The device of claim 13, wherein the receiver, the decoder, and the classifier are integrated into a mobile communication device.

15. The device of claim 13, wherein the receiver, the decoder, and the classifier are integrated into a base station, the base station comprising a transcoder that includes the decoder.

16. The device of claim 1, the decoder further configured to:

extract the two or more parameters from the encoded audio signal, the encoded audio signal comprising a bit stream that represents the audio stream and includes the two or more parameters; and after the two or more parameters are extracted from the encoded audio signal, decode the encoded audio signal to generate a decoded audio signal, wherein the synthesized signal is generated based on the decoded audio signal.

17. The device of claim 1, the decoder including multiple decoders and a switch, wherein the switch is configured to:

identify the two or more parameters included in the encoded audio signal; and route the encoded audio signal to a particular decoder of the multiple decoders.

18. The device of claim 17, wherein the particular decoder is configured to decode the encoded audio signal and to provide a decoded audio signal to a synthesized signal generator of the decoder, and wherein the multiple decoders include a linear predictive coding (LPC) mode decoder, a transform mode decoder, a noise generator, or a combination thereof.

19. The device of claim 1, wherein the classifier is configured to classify the synthesized signal further based on a pitch stability parameter derived from the two or more parameters included in the encoded audio signal and based on one or more parameters determined based on the synthesized signal.

20. The device of claim 19, wherein the classifier is configured to classify the synthesized signal as a speech signal, a non-speech signal, a music signal, a noisy speech signal, a background noise signal, or a combination thereof.

21. A method of processing an audio signal, the method comprising:

receiving an encoded audio signal at a decoder, the encoded audio signal representing an audio stream and including two or more parameters;

decoding the encoded audio signal to generate a synthesized signal; and classifying the synthesized signal based on the two or more parameters included in the encoded audio signal, wherein at least one parameter of the two or more parameters comprises a core indicator, a coding mode, a coder type, a low pass core decision, or a pitch value.

22. The method of claim 21, wherein the synthesized signal is classified further based on a pitch stability parameter derived from the at least one parameter included in the encoded audio signal.

23. The method of claim 21, wherein classifying the synthesized signal is further based on at least one parameter determined based on the synthesized signal, and further comprising calculating the at least one parameter determined based on the synthesized signal, wherein the at least one parameter determined based on the synthesized signal comprises a signal-to-noise ratio, a zero crossing, an energy distribution, an energy compaction, a signal harmonicity, or a combination thereof.

24. The method of claim 21, wherein classifying the synthesized signal is performed on a frame-by-frame basis, and wherein the synthesized signal is classified as a speech signal or a non-speech signal.

25. The method of claim 24, further comprising:

outputting an indication of a classification of the synthesized signal; and selectively processing, based on the indication, the synthesized signal to generate an audio signal.

26. The method of claim 21, wherein the decoder is included in a device that comprises a mobile communication device.

27. A computer-readable storage device storing instructions that, when executed by a processor, cause the processor to perform operations comprising:

decoding an encoded audio signal to generate a synthesized signal, the encoded audio signal representing an audio stream and including two or more parameters; and classifying the synthesized signal based on the two or more parameters included in the encoded audio signal, wherein at least one parameter of the two or more parameters comprises a core indicator, a coding mode, a coder type, a low pass core decision, or a pitch value.

28. The computer-readable storage device of claim 27, wherein a second parameter of the two or more parameters included in the encoded audio signal relates to a coding mode, a coder type, or both, wherein the coding mode comprises an algebraic code-excited linear prediction (ACELP) mode, a transforms coded excitation (TCX) mode, or a modified discrete cosine transform (MDCT) mode, and wherein the coder type comprises voiced coding, unvoiced coding, music coding, or transient coding.

29. An apparatus comprising:

means for receiving an encoded audio signal representing an audio stream and including two or more parameters;

means for decoding an encoded audio signal to generate a synthesized signal; and means for classifying the synthesized signal based on the two or more parameters included in the encoded audio signal, wherein at least one parameter of the two or more parameters comprises a core indicator, a coding mode, a coder type, a low pass core decision, or a pitch value.

30. The apparatus of claim 29, wherein the means for receiving, the means for decoding, and the means for classifying are integrated into a mobile communication device.

* * * * *